US005254804A

United States Patent [19]

Tamaki et al.

[11] Patent Number: 5,254,804

[45] Date of Patent: Oct. 19, 1993

[54] ELECTRONIC PIANO SYSTEM ACCOMPANIED WITH AUTOMATIC PERFORMANCE FUNCTION

[75] Inventors: Takashi Tamaki; Yasutoshi Kaneko, both of Hamamatsu, Japan

[73] Assignee: Yamaha Corporation, Hamamatsu, Japan

[21] Appl. No.: 502,535

[22] Filed: Mar. 30, 1990

[30] Foreign Application Priority Data

Mar. 31, 1989 [JP] Japan ..... 1-83805
Mar. 31, 1989 [JP] Japan ..... 1-83806

[51] Int. Cl.[5] ..... G10C 3/18; G10H 1/34; G10F 1/02

[52] U.S. Cl. ..... 84/626; 84/658; 84/DIG. 7; 84/462

[58] Field of Search ..... 84/745, 626, 645, 115, 84/461, 462, 662, 433, 724, 236-255, 174, DIG. 7, 658

[56] References Cited

U.S. PATENT DOCUMENTS 4,351,221 9/1982 Starnes et al. .
4,674,384 6/1987 Sakurai ..... 84/626
4,768,412 9/1988 Sanderson ..... 84/462
4,776,253 10/1988 Downes ..... 84/645
4,790,230 12/1988 Sanderson ..... 84/462
4,899,631 2/1990 Baker ..... 84/433
4,913,026 4/1990 Kaneko et al. ..... 84/DIG. 7
5,012,715 5/1991 Matsunaga et al. ..... 84/724

*Primary Examiner*—William M. Shoop, Jr.
*Assistant Examiner*—Helen Kim
*Attorney, Agent, or Firm*—Spensley Horn Jubas & Lubitz

[57] ABSTRACT

An electronic piano system provides an automatic performance piano capable of automatically carrying out pre-recorded performance, plus a key-return speed detecting unit and/or a string-striking speed presuming unit. When a depressed key is released so that a key is to be returned to its original position, a key-return speed is occurred, which is detected by the key-return speed detecting unit. On the other hand, when the key is depressed so that a hammer strikes a string in order to generate the corresponding sound, a string-striking speed of hammer is occurred. Based on a detected key-striking speed, the string-striking speed presuming unit presumes the corresponding string-striking speed. Thus, by use of the detected key-return speed and/or presumed string-striking speed, the automatic performance can be carried out with high fidelity.

11 Claims, 20 Drawing Sheets

| MEASURING POINT | FC1 | FC2 |
|---|---|---|
| L4 | ON | ON |
| L3 | ON | OFF |
| L2 | OFF | OFF |
| L1 | OFF | ON |

ELECTRONIC PIANO SYSTEM ACCOMPANIED WITH AUTOMATIC PERFORMANCE FUNCTION

BACKGROUND OF THE INVENTION

1. Field of the Invention

The present invention relates to an electronic piano system accompanied with an automatic performance function.

2. Prior Art

The electronic piano accompanied with the automatic performance function (hereinafter, simply referred to as an automatic performance piano) provides a recording mode where performance information given by a performer is to be recorded and an automatic performance mode where an automatic performance is to be carried out by recorded performance information (or performance information supplied from an external device and the like). In the recording mode when the performance played by the performer is to be recorded, it is necessary to measure a string-striking force of a hammer and then convert a measured string-striking force into an electric signal. In order to carry out the above-mentioned measurement, the conventional automatic performance piano provides a key position sensor for detecting a depressed position of each key and a hammer position sensor for detecting a passing position of each hammer. Then, key-depression and key-release events are detected based on an output of the key position sensor, while a key-striking force is detected based on the timing when the hammer passes through certain set position of the hammer position sensor. The key-striking force obtained at a timing when the key-depression is detected is outputted as data indicative of a velocity of MIDI (Musical Instrument Digital Interface) signal.

However, the conventional automatic performance piano must be complicated in its mechanism because it provides two sensors as described above, which raises up the manufacturing cost of the automatic performance piano.

In general, it can be said that the key-depression speed corresponds to the key-striking force. In this case, the time when the key passed through the key position sensor is measured at first. Then, it is possible to presume the key-striking speed from the measurement result by use of a conversion table which is provided in advance. Thus, by using such conversion table, it is possible to omit the hammer position sensor, by which the construction of the piano can be simplified.

However, the key-depression speed is not constant, because the key-depression speed may be varied from key-depression start timing to key-depression end timing due to the performance technique, performer's habit and the like. In addition, the final string-striking speed of the hammer has strong correlation with variation of the key-depression speed. In short, it is not possible to presume the string-striking force with accuracy by merely detecting the key-depression speed at the predetermined fixed position.

Further, there is a so-called "mis-touch" case where the key is slightly depressed by mistake but the performer does not intend to generate the sound. In such case, if there is provided the key position sensor only, there is a problem in that the string-striking event is detected to be occurred by mistake.

Meanwhile, there is another conventional piano which provides both of the key position sensor for detecting the key-depressed position at one detection point and the hammer position sensor for detecting the hammer-passing positions at two detection points. Herein, it is possible to omit the hammer position sensor by providing the key position sensor which detects the key-depressed positions at two detection points. In this case, by use of the time when the key passes between these two detection points of the key position sensor, the string-striking force is presumed.

In the above-mentioned case, a key touch when the performer returns (or releases) the key is slightly varied in accordance with performance or tune modes such as "legato", "staccato" etc. Based on the difference of key touch, a key-returning (or key-releasing) speed is varied, which affects an operation of a damper which covers the string and prevents it from vibrating. In other words, due to the difference of the key touch, the vibration of string is rapidly stopped in staccato (as shown in FIG. 24) or the vibration of string is smoothly stopped in legato (as shown in FIG. 25). Therefore, in order to reproduce the performance with high fidelity, it is necessary to detect the key-returning speed in the manual performance. Then, based on the detection result, it is necessary to control the key-returning speed in the automatic performance.

However, in the automatic performance piano whose key position sensor detects the key-depressed position at one detection point, it is not possible to detect the key-returning speed.

On the other hand, in another automatic performance piano whose key position sensor detects the key-depressed position at two detection points, it is possible to detect the key-returning speed roughly. Such sensor can merely detect the average speed of the depressing key which passes between two detection points, however, the detected speed cannot correspond to the touch variation. In addition, two detection points are fixed at positions where the key-depression/key-release are detected. Therefore, the distance between two detection points should be so large that sufficient resolution in the speed detection cannot be obtained. In this case, most significant value of the key-returning speed is the value to be detected at a timing when the damper starts to prevent the string from vibrating. In contrast, it is impossible to expect the high fidelity of performance by using the average key-returning speed or the key-returning speeds at other timings. In short, it is necessary to detect the key-returning speed with high resolution at the most significant timing.

Further, the conventional piano fixes the detection points, which cannot be arbitrarily selected.

SUMMARY OF THE INVENTION

It is accordingly a primary object of the present invention to provide an automatic performance piano capable of presuming the string-striking force with accuracy with simple mechanism.

It is another object of the present invention to provide an automatic performance piano capable of detecting the key-returning speed with high resolution.

In a first aspect of the present invention, there is provided an electronic piano system accompanied with an automatic performance function comprising:

(a) an automatic performance piano capable of automatically carrying out pre-recorded performance; and (b) a key-return speed detecting unit for detecting a key-return speed which is occurred when a depressed key is released, whereby an automatic performance can be carried out with high fidelity by use of a detected key-return speed.

In a second aspect of the present invention, there is provided an electronic piano system accompanied with an automatic performance function comprising:

(a) an automatic performance piano capable of automatically carrying out pre-recorded performance; and (b) a string-striking speed presuming unit for presuming a string-striking speed of a hammer when a key of the automatic performance piano is depressed so that the hammer strikes a string, whereby an automatic performance can be carried out with high fidelity by use of a presumed string-striking speed.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings.

DESCRIPTION OF A PREFERRED EMBODIMENT

Figure 1A:
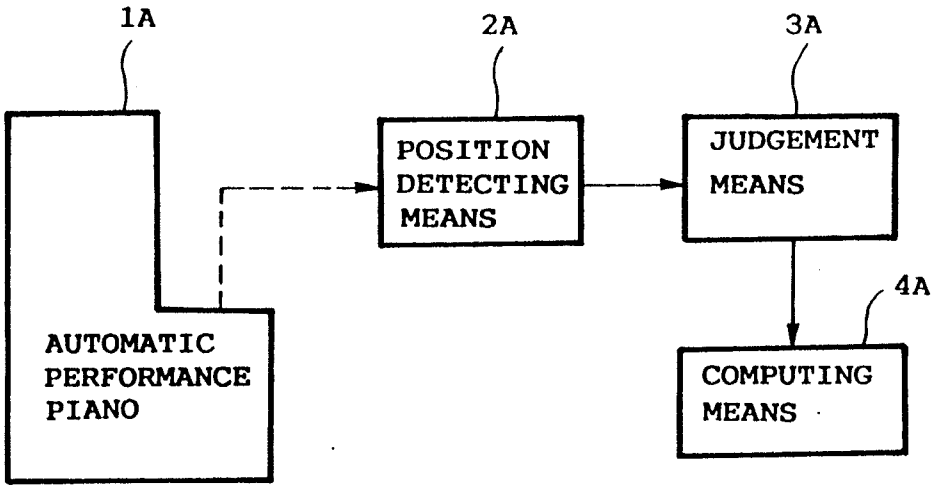
FIGS. 1A, 1B are block diagrams respectively showing two different types of fundamental configurations of the electronic piano system according to the present invention.

[A] Basic Configuration and Operation of Electronic Piano System (1) Key-Return Speed Detecting Unit FIG. 1A shows a basic configuration of an electronic piano system providing a key-return speed detecting unit. This system provides an automatic performance piano 1A, a position detecting means 2A, a judgement means 3A and a computing means 4A. The position detecting means 2A detects the key-return position of the key in the automatic performance piano 1A. The judgement means 3A judges whether or not the detected key-return position coincides with the specific position which is determined in advance. If the judgment means 3A judges that the detected key-return position coincides with the specific position, the computing means 4A computes the key-return speed based on the passing time of the key which passes between the specific position and another predetermined position which is disposed prior to the specific position in key-return direction.

Herein, the above-mentioned specific position can be arbitrarily determined, and the key-return speed can be automatically computed based on the passing time of the key which passes in the vicinity of the arbitrary specific position.

Therefore, it is possible to control the key-return operation in the reproduction mode in accordance with the key-return speed detected in the recording mode of the automatic performance piano. In this case, based on the detected key-return speed, it is possible to carry out the open-loop control on the key-return operation, by which it is possible to obtain the control precision corresponding to that of the feedback control.

(2) String-Striking Speed Presuming Unit

Figure 1B:
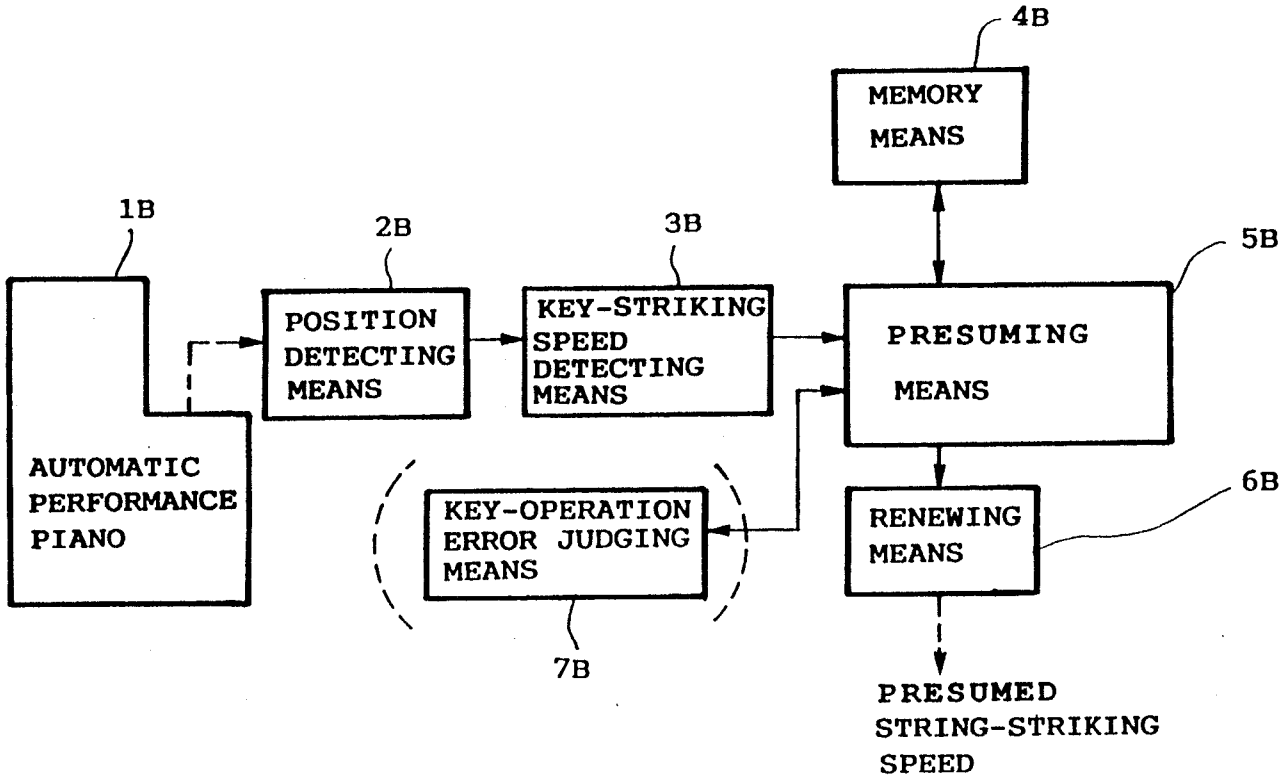

FIG. 1B shows a basic configuration of the electronic piano system providing a string-striking speed presuming unit. This system provides an automatic performance piano 1B, a position detecting means 2B, a key-striking speed detecting means 3B, a memory means 4B, a presuming means 5B and a renewing means 6B (and a key operation error judging means 7B).

Herein, the position detecting means 2B outputs a detection signal every time the key of the automatic performance piano 1B is positioned at each of plural reference positions. Then, based on a first time when the detection signal is precedingly generated by the position detecting means 2B and a second time when the detection is currently generated by 2B, the key-striking speed detecting means 3B detects a key-striking speed which is occurred at a current reference position at which the key is currently positioned when depressing the key. The memory means 4B pre-stores the relation between the key-striking speed and string-striking speed of the hammer. Then presuming means 5B presumes the string-striking speed corresponding to the detected key-striking speed by use of the contents of the memory means 4B, so that the presumed string-striking speed is obtained with respect to the current reference position. Thereafter, the renewing means 6B renews the precedingly presumed string-striking speed by the currently presumed string-striking speed when the currently presumed string-striking speed is larger than the precedingly presumed string-striking speed.

Next, the key-operation error judging means 7B judges whether or not the presumed string-striking speed is in the predetermined speed range. If not, the key-operation error judging means 7B judges that the current key-operation is error. Then, the present system omits the performance information made by such key-operation error which corresponds to the foregoing mis-touch operation.

Embodiment (1) Configuration of Embodiment

Figure 2:
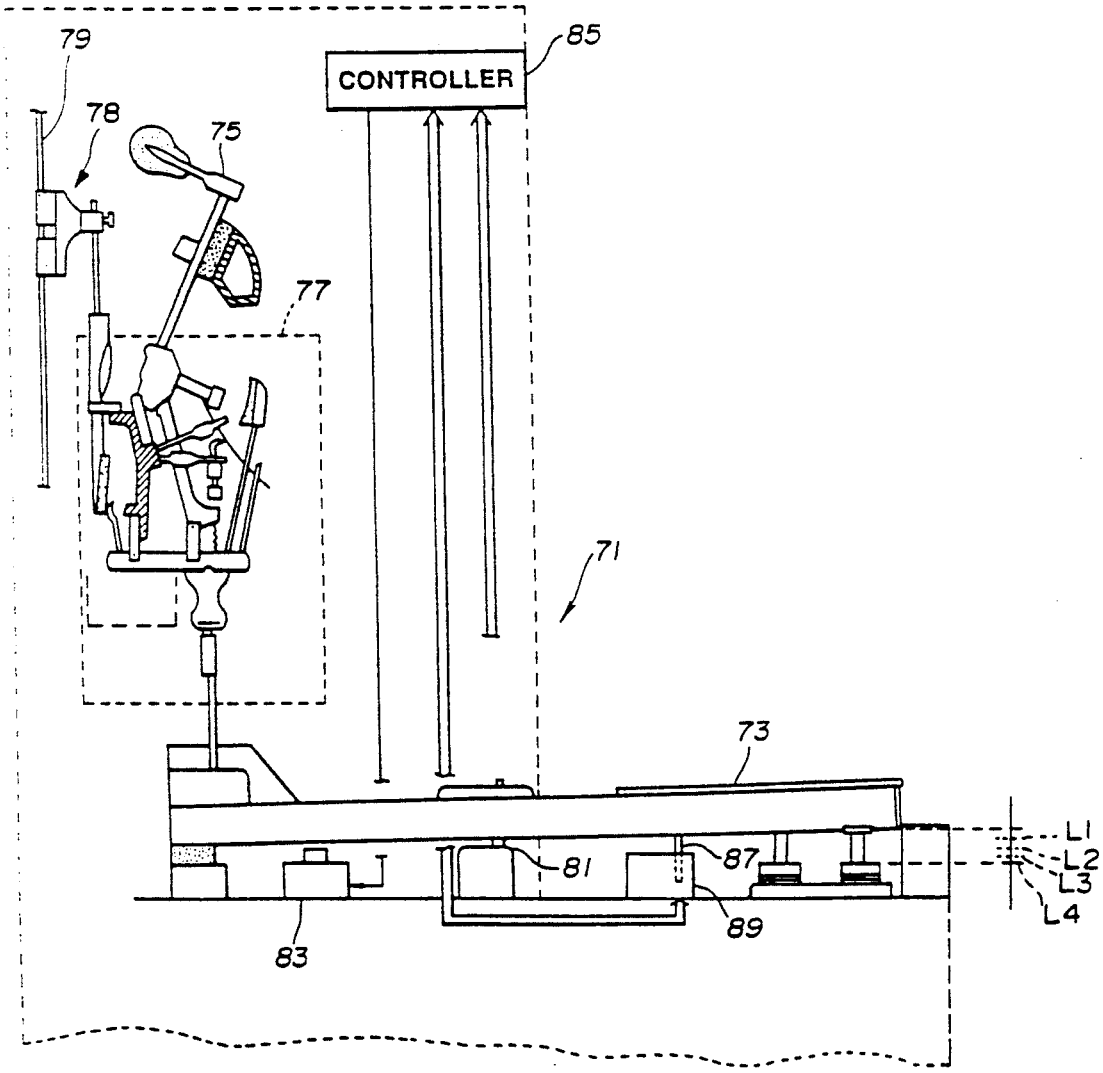
FIG. 2 is a side sectional view showing a mechanical construction of the automatic performance piano according to an embodiment of the present invention.

Next, description will be given with respect to the mechanical configuration of the automatic performance piano according to an embodiment of the present invention by referring to FIG. 2. In FIG. 2, an automatic performance piano 71 provides a keyboard consisting of plural keys (each represented by numeral 73), each string-striking mechanism 77 which transmits an operation of each key 73 to each hammer 75, each string 79 to be struck by each hammer 75, each damper 78 which prevents each string 79 from vibrating, a pedal mechanism (not shown) and a solenoid (see numeral 80 in FIG. 7) which drives such pedal mechanism.

The key 73 can freely and rotably move about a balance pin 81. When the key 73 is depressed or when a plunger is projected from a solenoid 83 so that a plunger rotably moves down the edge portion of the key 73, such key movement is transmitted to the hammer 75 and damper 78. Thus, the damper 78 moves apart from the string 79 and the hammer 75 rotably moves in left direction of FIG. 2 so that the string 79 is struck by the hammer 75.

Figures 5, 6:
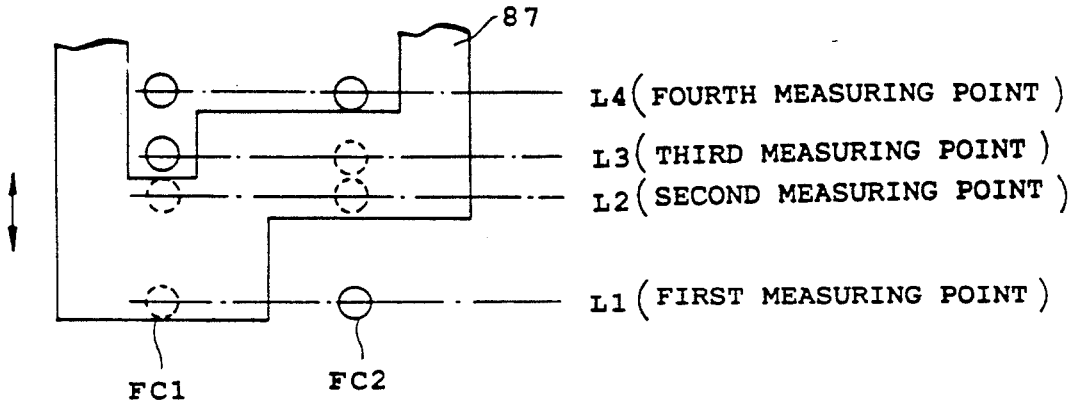
FIGS. 5, 6 are drawings showing an operation of a key position sensor.

In addition, a shutter 87 is attached at the lower surface of the key 73, and a position sensor 89 is arranged such that a shutter 87 can be inserted therein. As shown in FIG. 5, the position sensor 89 provides photo-interrupters FC1, FC2 which are fixed at the predetermined positions thereof. Based on the combination of detection signals generated from the photo-interrupters FC1, FC2, the position of the key 73 can be detected by the position sensor 89.

Next, description will be given with respect to the position detecting principle of the position sensor 89. FIG. 5 shows relative position relations between the shutter 87 and photo-interrupters FC1, FC2. Herein, the shutter 87 actually moves up or down and the photo-interrupters FC1, FC2 are fixed in the position sensor 89, however, FIG. 5 shows in such a manner that the shutter 87 is fixed and the photo-interrupters FC1, FC2 are moved by predetermined intervals for convenience' sake.

In first case where the photo-interrupters FC1, FC2 are at first measuring point L1, the shutter 87 having the step-like shape shuts off the light from the photo-interrupter FC1 only, so that FC1 is off but FC2 is on. Herein, only the photo-interrupter which is turned on can generate the detection signal. The first measuring point L1 corresponds to the key-position when the key is initially and slightly depressed by first level. Similarly, the second, third, fourth measuring points L2, L3, L4 correspond to the key-positions when the key is depressed deeper by second, third, fourth levels. In second case where the key 73 is depressed by the second level so that the photo-interrupters FC1, FC2 are at the second measuring point L2, both of FC1, FC2 are off. In third case where the photo-interrupters FC1, FC2 are at the third measuring point L3, FC1 is on but FC2 is off. In fourth case where key 73 is further depressed by the fourth level and consequently the photo-interrupters FC1, FC2 are at the fourth measuring point L4 so that the string is to be almost struck, both of FC1, FC2 are turned on. FIG. 6 shows the relation between the on/off conditions of FC1, FC2 and measuring points.

Figure 3A:
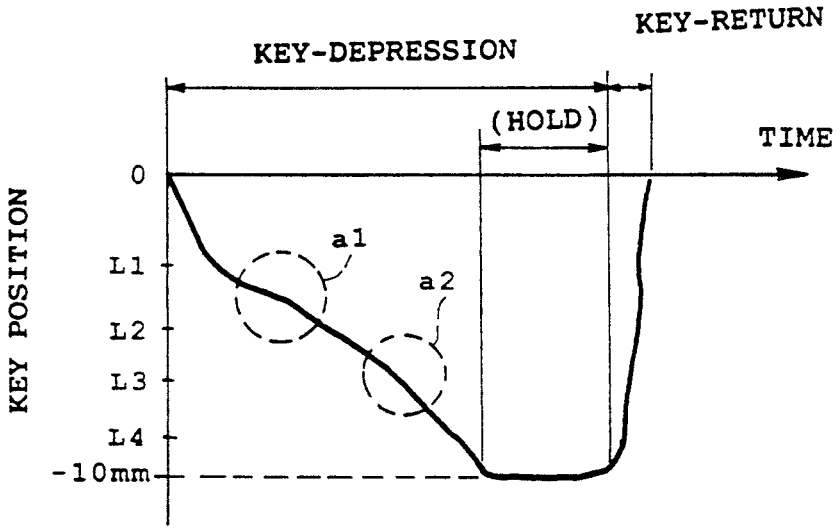
FIGS. 3A, 3B, 4A, 4B are timing charts indicating key operations and hammer movements.
Figure 3B:
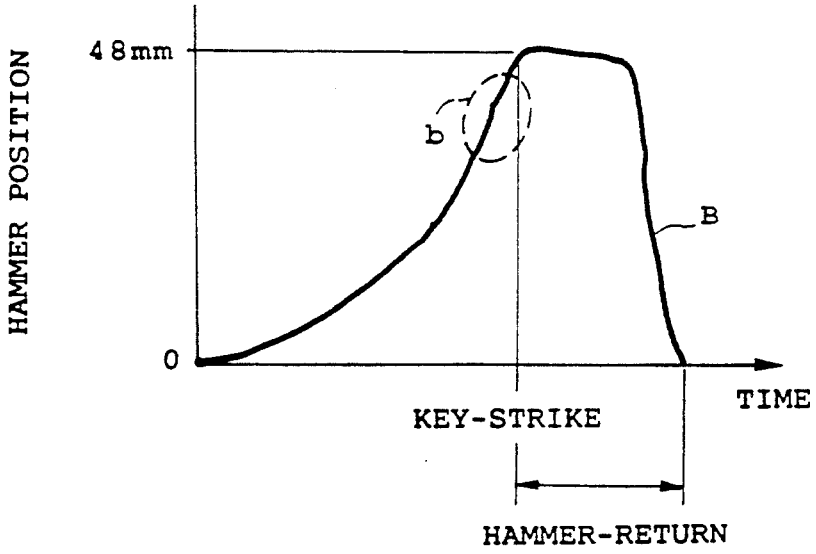

Meanwhile, FIGS. 3A, 3B show the variation of key-position (i.e., moving trace of the key 73) and variation of hammer-position respectively wherein the key-depression is carried out slowly and smoothly. As shown in FIG. 3A, the key-depressing speed is not constant in the key-depressing process. For example, the key-depressing speed at portion "a1" is different from that at portion "a2". In addition, the hammer-moving speed at portion "b" is different from and faster than that at initial portion corresponding to the timing when the key is initially depressed.

Figure 4A:
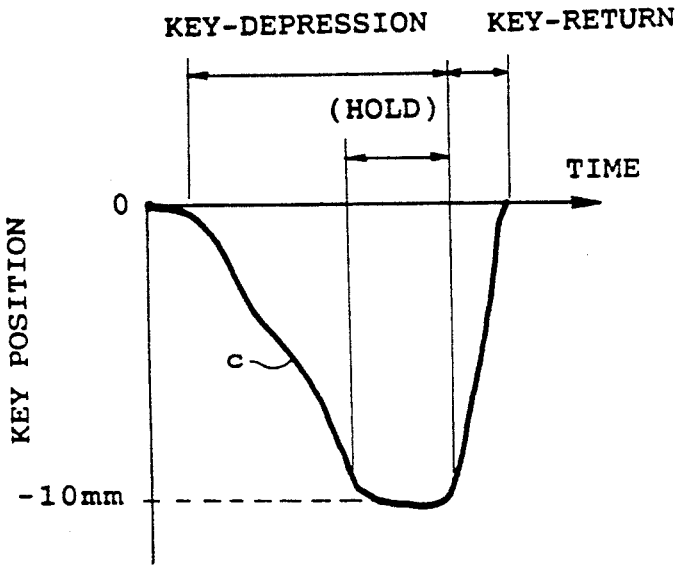
Figure 4B:
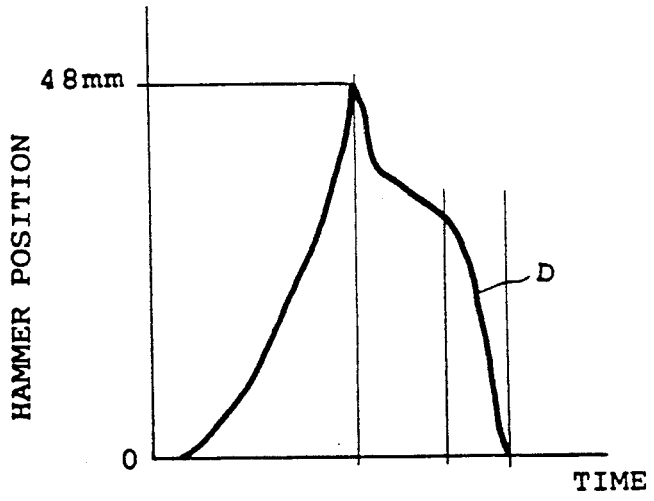

On the other hand, FIGS. 4A, 4B show the variation of key-position and variation of hammer-position respectively wherein the key-depression is carried out rapidly. It is apparent from FIGS. 4A, 4B, the final string-striking force is affected by the variation of the key-depressing speed.

Figure 7:
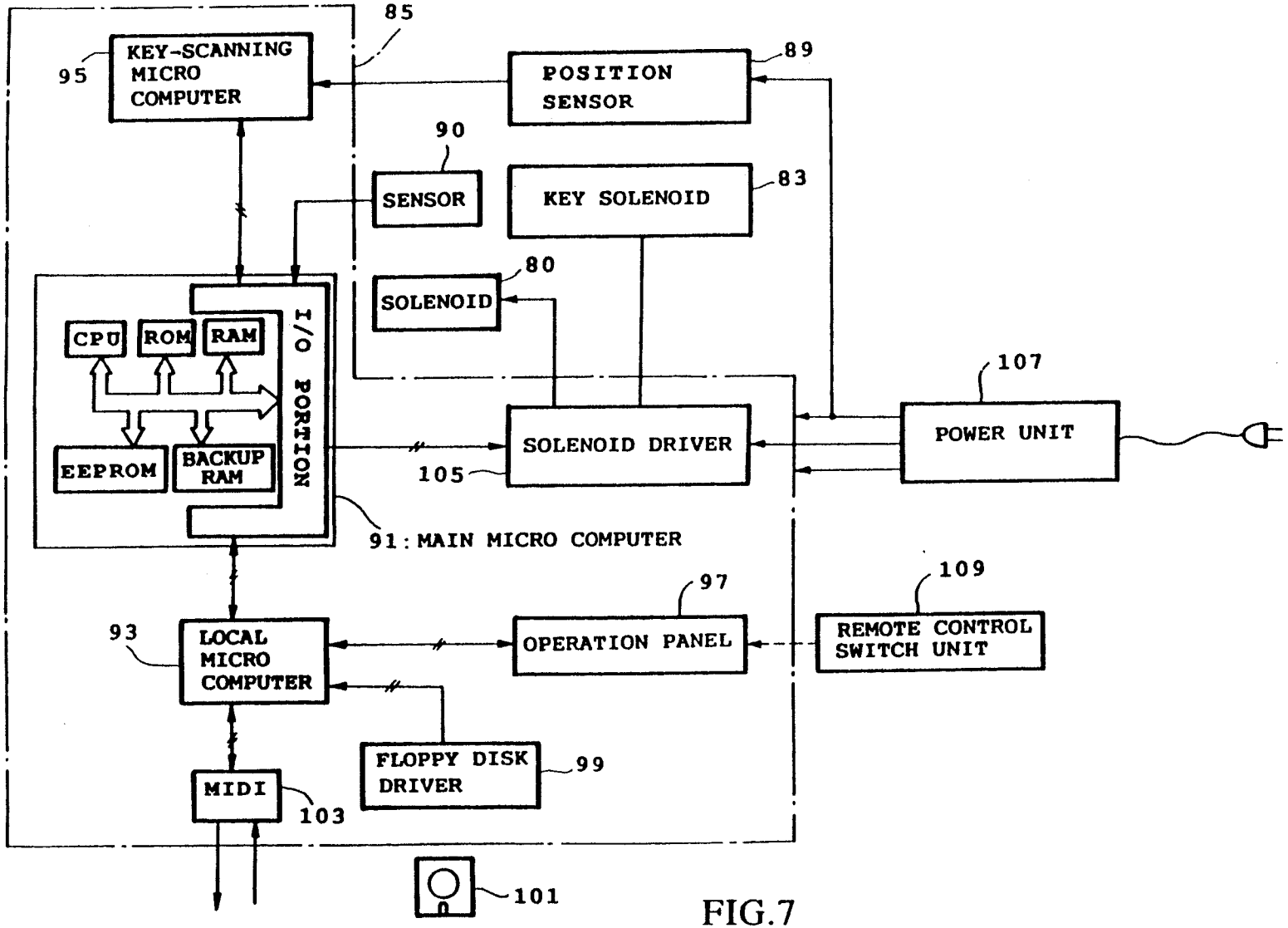
FIG. 7 is a block diagram showing an electric configuration of an embodiment of the present invention.

Next, the output of the position sensor 89 shown in FIG. 2 is supplied to a controller 85 wherein the key-position is to be detected. The controller 85 is constructed as shown in FIG. 7. In FIG. 7, a main micro computer 91 is designed to control several circuit portions. Under control of the main micro computer 91, a local micro computer 93 and a key-scanning micro computer 95 operate. The local micro compute 93 is provided for controlling a floppy disk driver 99 which stores information on a floppy disk 101. The main micro computer 91 provides a central processing unit (CPU), a read-only memory (ROM), a random-access memory (RAM), an electrically erasable programmable ROM (EEPROM), a backup RAM and the like, which function as an arithmetic logic unit (ALU). Such circuit elements within the main micro computer 91 can transfer data via a common bus and an I/O portion.

In addition, an operation panel 97 provides several kinds of switches and controls which can be operated by the operator. This operation panel 97 can also input switch information transmitted from a remote control switch unit 109. The local micro computer 93 receives the switc information from the remote control switch unit 109 and another switch information which is obtained by scanning operations of switches provided in the operation panel 97. Then, the local micro computer 93 supplies the received switch information to the main micro computer 91. Further, the local micro computer 93 controls the floppy disk driver 99 to thereby transmit the performance information read from the floppy disk 101 to the main micro computer 91. Furthermore, under control of the local micro computer 93, the performance information outputted from the main micro computer 91 is written into the floppy disk 101. Meanwhile, MIDI (Musical Instrument Digital Interface) information can be transferred between the local micro computer 93 and an externally provided electronic musical instrument (not shown) via a MIDI I/O portion 103. It is known that the MIDI information includes velocity information corresponding to the string-striking information.

Meanwhile, the key-scanning micro computer 95 sequentially scans the output of the position sensor 89 with respect to each key. Based on the scanning result, i.e., output of the position sensor 89, the key-scanning micro computer 95 generates a position code indicative of the key-position corresponding to any one of the measuring points L1 to L4. Such position code is supplied to the main micro computer 91. In addition, the key-scanning micro computer 95 also supplies a key code which specifies the depressed key to the main micro computer 91.

Based on the position code, the main micro computer 91 measures the passing time corresponding to each measuring point. In this case, the distance between adjacent measuring points is predetermined and un-changeable. Thus, the time difference between the measured passing times directly corresponds to the key-striking speed. In short, the main micro computer 91 substantially measures the key-striking speed. Thereafter, the main micro computer 91 will presume the key-striking force based on the measured time difference, which will be described later in detail. In the present embodiment, the main micro computer 91 receives pedal information representative of pedal-depression/release from a pedal sensor 90 which is built in the foregoing pedal mechanism. Thus, the main micro computer 91 generates the performance information based on the presumed key-striking force, pedal information etc. When receiving the performance information read from the floppy disk 101 via the local micro computer 93, the main micro computer 91 controls a solenoid driver 105 based on the read performance information. Thus, the solenoid driver 105 drives the key solenoid 83 and pedal solenoid 80, thereby carrying out the automatic performance.

Incidentally, 107 indicates a power unit which supplies the power to several circuit portions of FIG. 7.

(2) Operation of Embodiment

Next, description will be given with respect to the operation of the present embodiment by referring to FIGS. 8 to 19.

Figure 8:
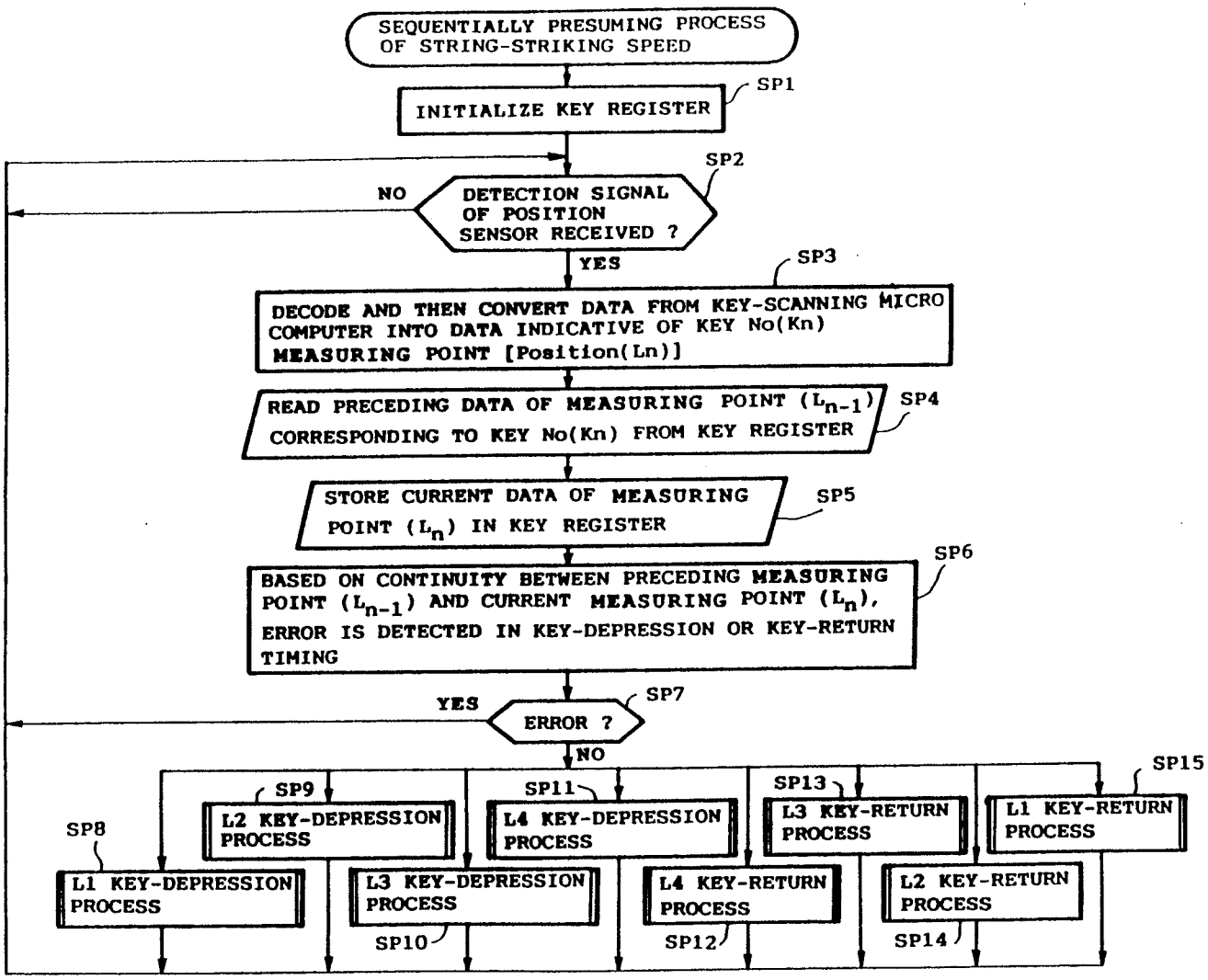
FIG. 8 is a flowchart showing a main routine to be executed by a main micro computer shown in FIG. 7.

FIG. 8 shows a main routine to be executed by the main micro computer 91. This main routine is activated in the recording mode and then repeatedly executed.

Figure 9:
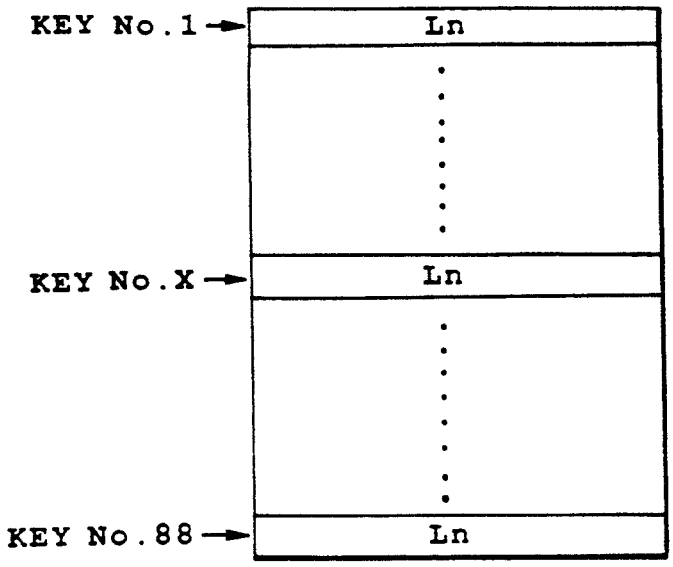
FIGS. 9, 10 are memory maps of registers used in the present embodiment.

In first step SP1 in FIG. 8, the CPU initializes a key register set in the RAM of the main micro computer 91. This key register has memory areas corresponding to key numbers No. 1 to No. 88 respectively as shown in FIG. 9. Then, measuring point data Ln indicative of any one of the four measuring points L1 to L4 is written in each memory area, wherein "n" of Ln denotes one of "1" to "4" corresponding to L1 to L4.

In next step SP2, it is judged whether or not the main micro computer 91 receives the position code and key code from the key-scanning micro computer 95. If the judgement result of this step SP2 is "NO", this judgement process of step SP2 is repeatedly carried out until the judgement result turns to "YES". When the judgement result of step SP2 turns to "YES", the processing proceeds to step SP3 wherein the main micro computer 91 decodes the position code and key code supplied from the key-scanning micro computer 95. Thus, the position code and key code are respectively converted into key number data Kn and measuring point data Ln. In next step SP4, precedingly stored position data $L_{n-1}$ is read from the memory area of the key register (see FIG. 9) corresponding to the key number data Kn. In this case, if the current position data Ln is the first data stored in the first memory area, the above-mentioned precedingly stored position data $L_{n-1}$ does not exist.

In step SP5, the current position data Ln is written into the corresponding memory area in the key register. In step SP6, the CPU compares the current position data Ln to the preceding position data $L_{n-1}$. Based on the continuity between Ln and $L_{n-1}$, it is judged whether or not the key-scanning error is occurred. In this case, if the position detection is carried out by the position sensor 89 without causing any error, the current position data is renewed in the order of L1→L2→L3→L4 in the key-depressing operation, while the current position data is renewed in the order of L4→L3→L2→L1 in the key-returning operation. In the case where the error takes place, i.e., in the case where the position data is not obtained at any one of the measuring points, the position data is not renewed in the above-mentioned order. The error judgement of step SP6 is performed based on the above-mentioned principle. In short, in the case where the normal data relation is not established between the adjacent position data Ln, $L_{n-1}$, step SP6 judges that the error is occurred. In next step SP7, it is judged whether or not the error is detected. If the judgement result of step SP7 is "YES", the processing returns to the foregoing step SP2 again. If the judgement result of step SP7 is "NO", the processing proceeds to one of sub-routines of steps SP8 to SP15, which is selected by the measuring point designated by the current position data Ln and key-operation (i.e., key-depressing operation or key-returning operation).

Next, description will be given with respect to each of two sub-routine groups corresponding to the key-depressing operation and key-returning operation.

(2-A) Key-Depressing Operation (a) Step SP8 (Sub-Routine of L1 Key-Depression Process)

Figure 10:
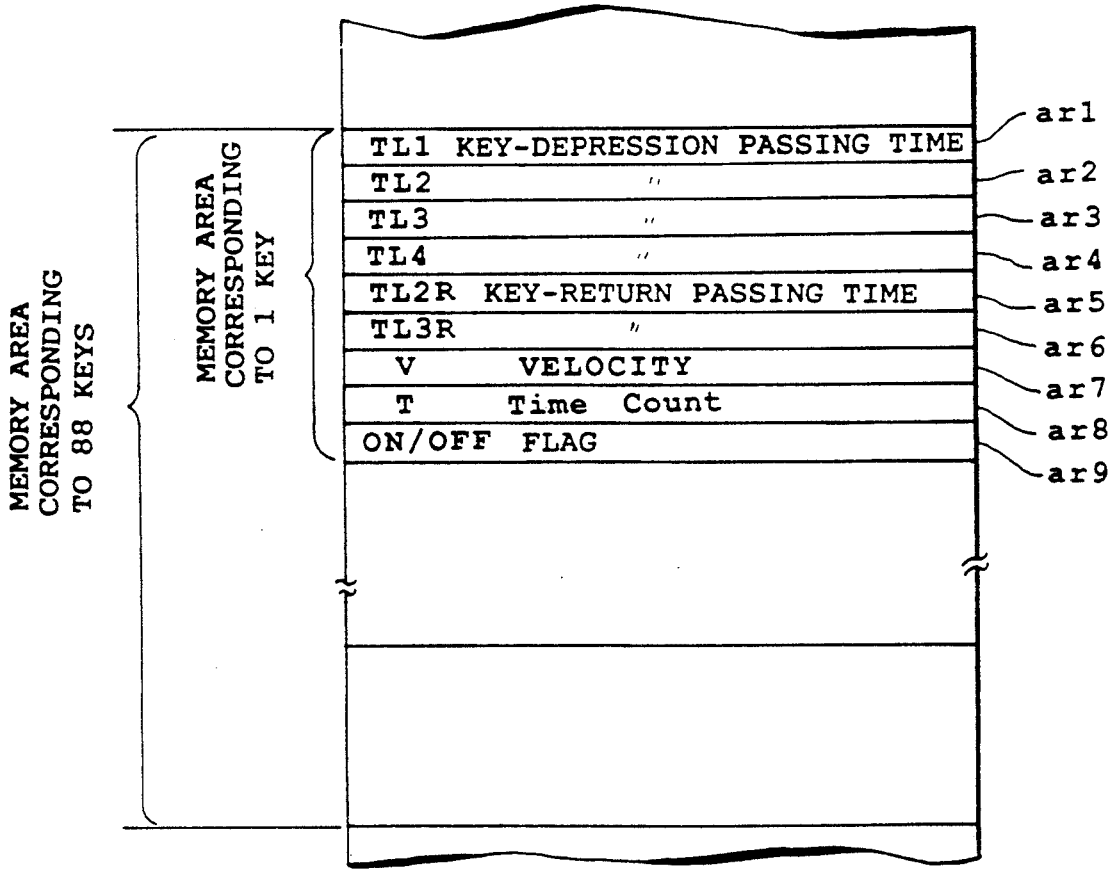
Figure 11:
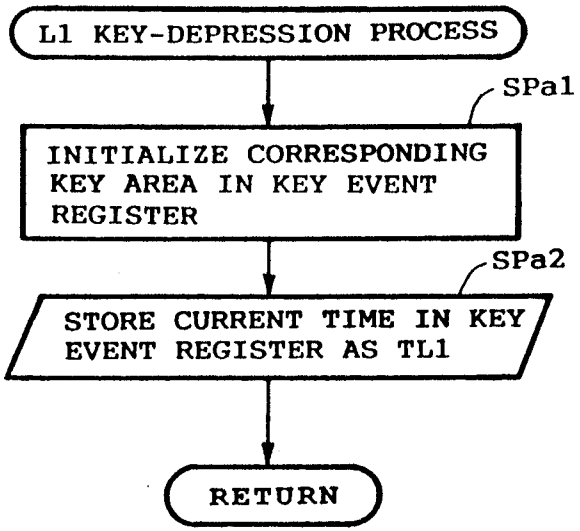

FIG. 11 is a flowchart showing this sub-routine. In first step SPa1 of FIG. 11, storage areas in a key event register corresponding to the numbers of the depressed keys are initialized. This key event register is set in the RAM of the main micro computer 91 shown in FIG. 7, the memory map thereof is shown in FIG. 10. The key event register has memory blocks corresponding to key numbers No. 1 to No. 88, each memory block consists of nine memory areas ar1 to ar9. Herein, the passing times of the key which passes the measuring points L1, L2, L3, L4 in the key-depressing operation are stored in the memory areas ar1, ar2, ar3, ar4 respectively; and other passing times of the key which passes the measuring points L2, L3 in the key-returning operation are stored in the memory areas ar5, ar6 respectively. In addition, a presumed string-striking speed V is stored in the memory area ar7; a tone-generation timing T is stored in the memory area ar8; and on/off flag indicative of the key-on (i.e., note-on) or key-off (i.e., note-off) is stored in the memory area ar9.

In next step SPa2, the current time is stored in the memory area ar1 within the memory block corresponding to the number of the currently depressed key as data TL1. Thereafter, the processing returns to the main routine (see FIG. 8).

(b) Step SP9 (Sub-Routine of L2 Key-Depression Process)

Figure 12:
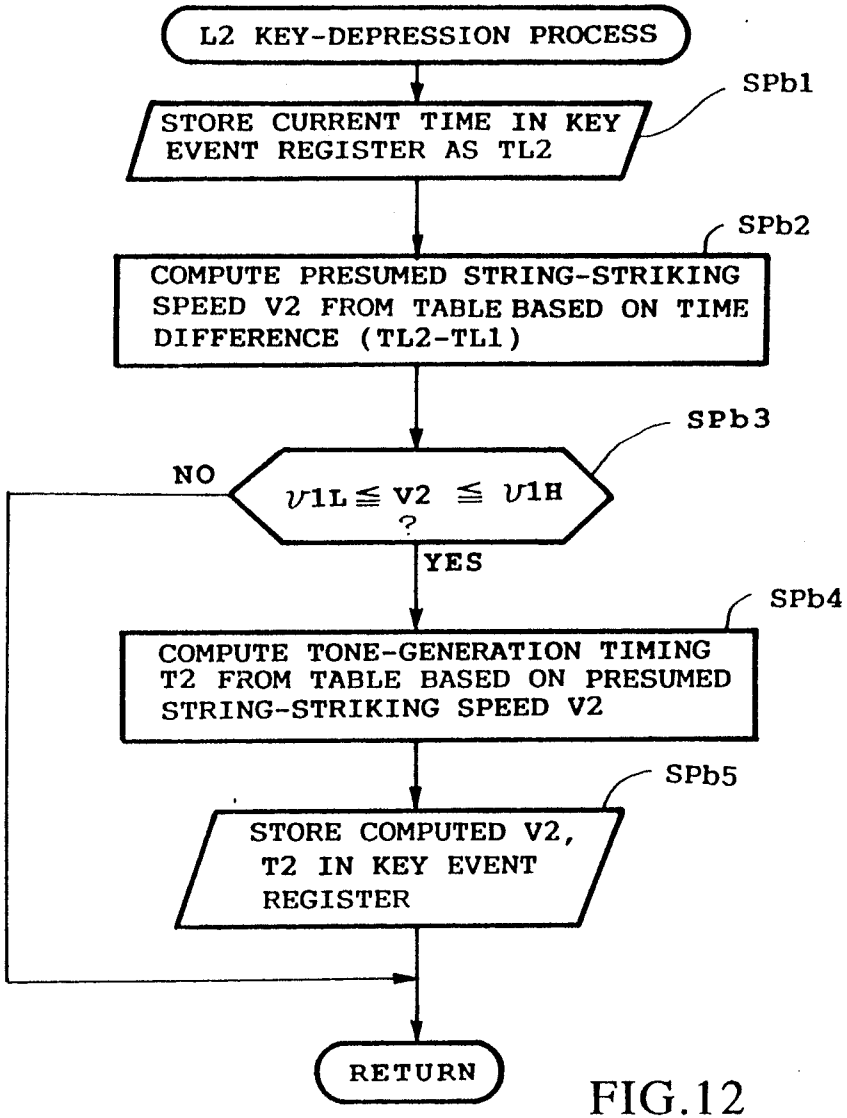
FIGS. 11 to 19 are flowcharts showing sub-routines to be executed in the present embodiment.
Figure 21:
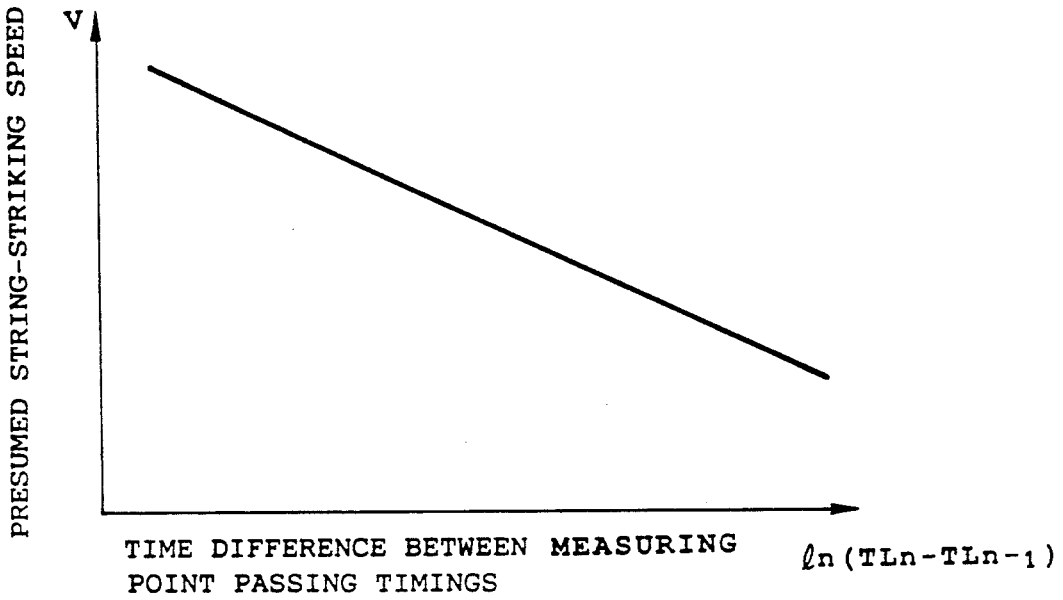
FIGS. 21, 22, 23 are graphs indicating contents of tables used in the present embodiment.

FIG. 12 is a flowchart showing this sub-routine. In first step SPb1 of FIG. 12, the current time is stored in the memory area ar2 within the memory block corresponding to the number of the currently depressed key as data TL2. In next step SPb2, time difference (TL2–TL1) is obtained by subtracting the data TL1 from the data TL2. Then, based on this time difference corresponding to the key-striking speed, the CPU computes the presumed string-striking speed V from a table which is set in the ROM of the main micro computer 91. This table has contents as shown in FIG. 21. More specifically, the horizontal line of FIG. 21 represents the above-mentioned time difference which is expressed by the logarithmic scale, i.e., $\ln(TLn-TL_{n-1})$, while the vertical line represents the presumed string-striking speed V. By use of the logarithmic value of the time difference, the CPU computes the presumed string-striking speed V2.

Figure 20:
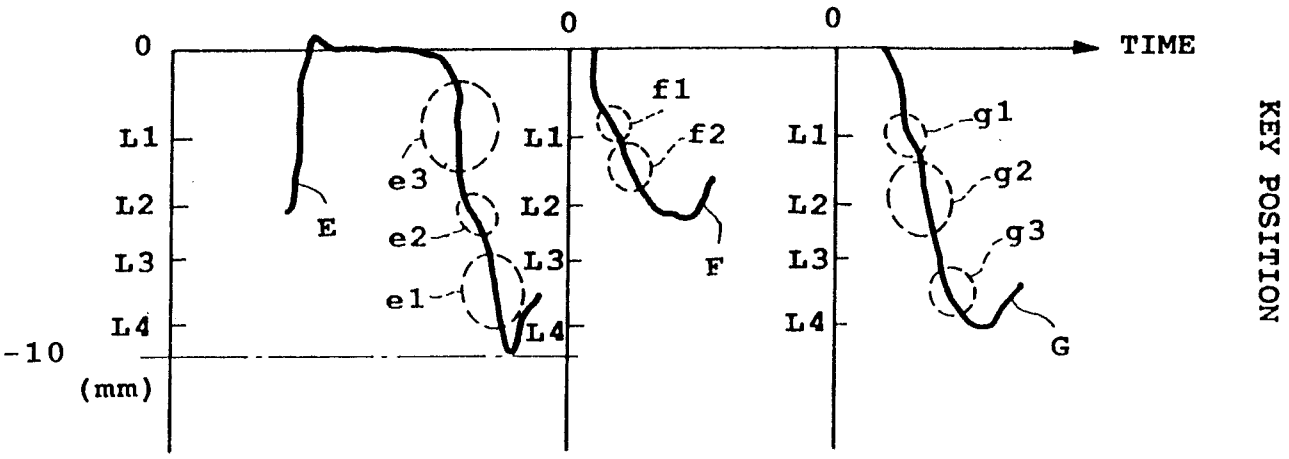
FIG. 20 is a timing chart showing a key movement.

In step SPb3, it is judged whether or not the presumed string-striking speed V2 computed in the foregoing step SPb2 is in the predetermined speed range defined by v1L, v1H. If the key-scanning error takes place, the presumed string-striking speed V2 will be out of the predetermined speed range. For example, in the case where the presumed string-striking speed V2 is lower than the lower limit speed v1L, it is judged that the key is depressed slowly at very small key-depressing speed, which may not be occurred in the normal key-depressing operation. On the other hand, in the case where V2 exceeds the upper limit speed vlH (as shown by "e1" of FIG. 20), the key is moved at high speed without bearing any load in such a manner that the key is not interlocked with the hammer.

Figure 22:
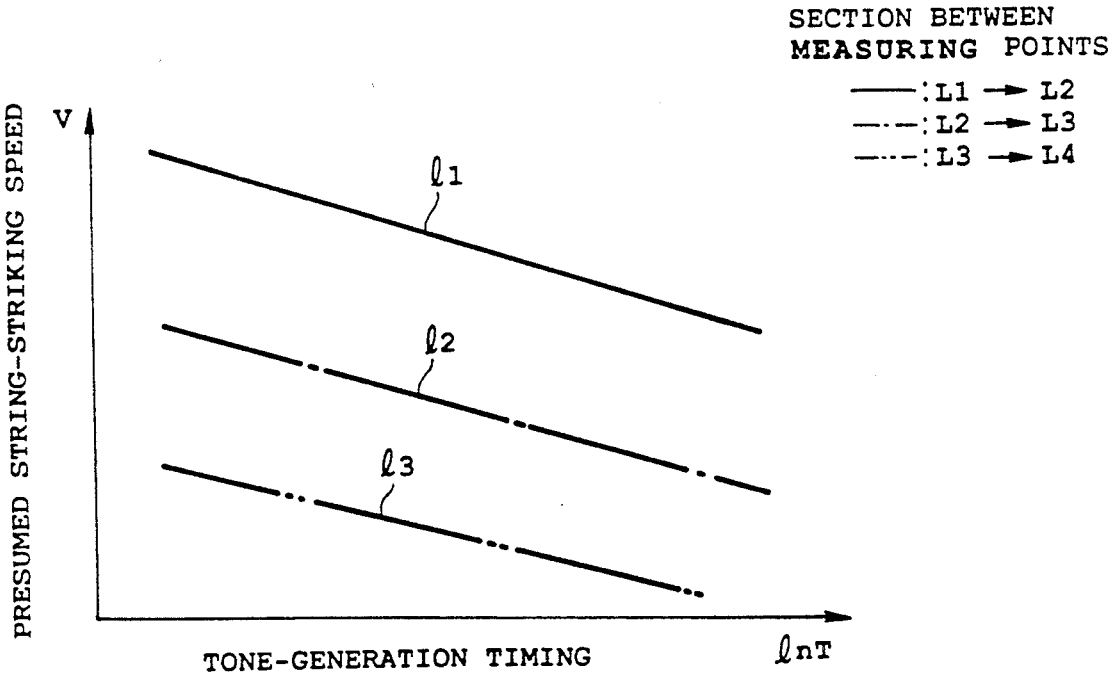

If the presumed string-striking speed V2 is in the normal speed range, the judgement result of step SPb3 turns to "YES" so that the processing proceeds to step SPb4. In step SPb4, based on the presumed string-striking speed V2, the CPU computes the tone-generation timing from a table which is set in the ROM of the main micro computer 91 and the contents thereof is as shown in FIG. 22. The vertical line of FIG. 22 represents the presumed string-striking speed, while the horizontal line represents the logarithmic value of the tone-generation timing, i.e., "lnT". FIG. 22 shows three lines 11, 12, 13 by which the tone-generation timing T is computed. Herein, the line 11 is used when the presumed string-striking speed V2 is computed based on the passing time of the key which passes through the section defined by the first measuring point L1 and second measuring point L2. Similarly, the line 12 is used to compute the presumed string-striking speed V3 in response to the section defined by L2, L3, and the line 13 is used to compute the presumed string-striking speed V4 in response to the section defined by L3, L4. In step SPb4, the tone-generation timing T2 is computed by use of the line 11.

After executing the process of step SPb4, the processing proceeds to step SPb5 wherein the presumed string-striking speed V2 and tone-generation timing T2 ar written in the memory areas ar7, ar8 in the key event register as the presumed string-striking speed V and tone-generation timing T. Thereafter, the processing returns to the foregoing main routine.

On the other hand, if the judgement result of step SPb3 is "NO", the key-operation error is detected so that the processing directly returns to the main routine without writing any data in the key event register.

(c) Step SP1O (Sub-Routine of L3 Key-Depression Process)

Figure 13:
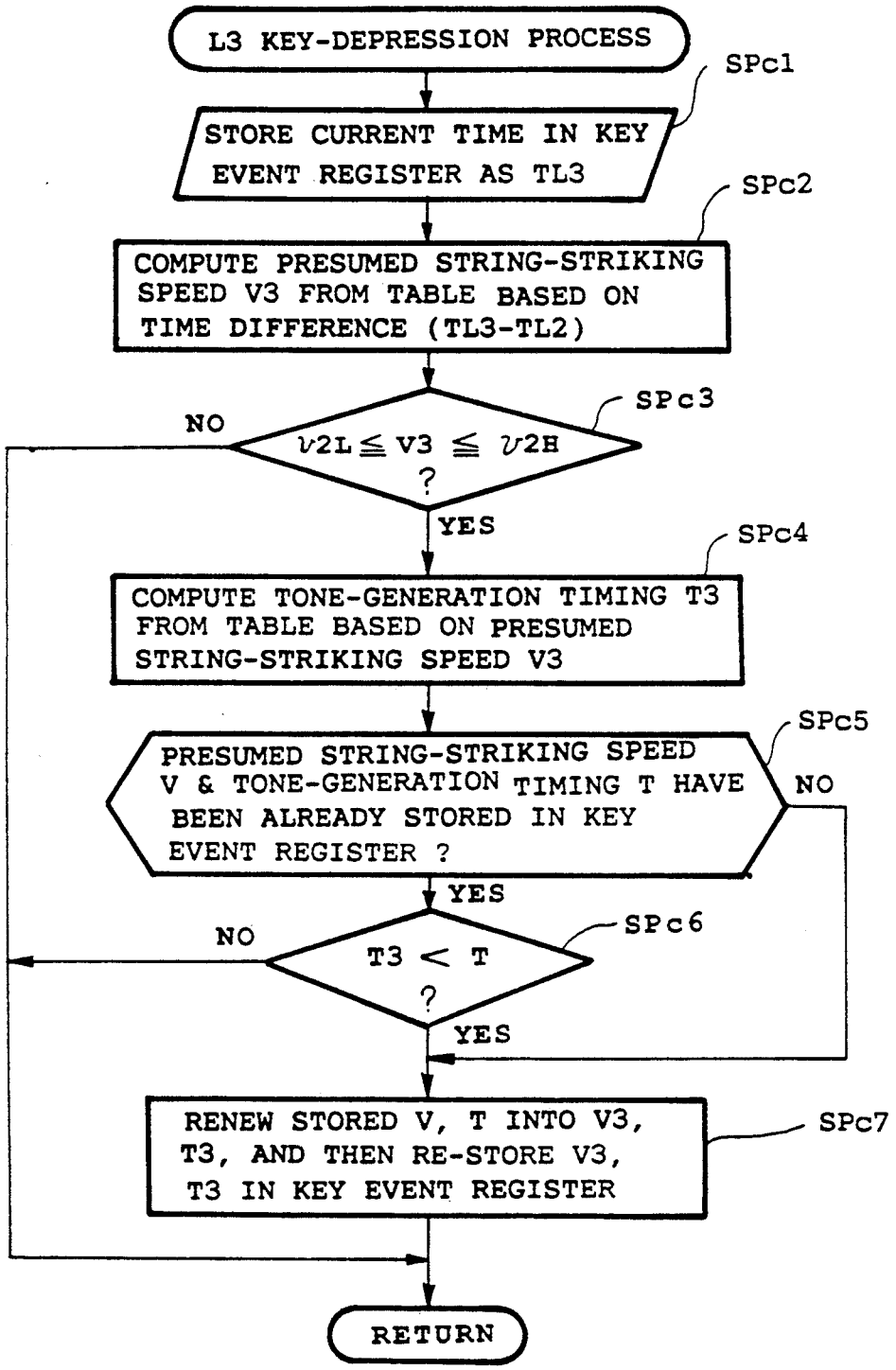

FIG. 13 is a flowchart showing this sub-routine. In first step SPc1 of FIG. 13, the current time is written in the memory area ar3 (see FIG. 10) in the memory block of the key event register corresponding to the number of the depressed key as data TL3. In next step SPc2, the CPU computes the time difference (TL3–TL2) by subtracting the data TL2 from the data TL3. Then, based on the computed time difference (TL3–TL2), the CPU computes the presumed string-striking speed V3 from the table (see FIG. 21). In step SPc3, it is judged whether or not the inequality "$v2L \leqq v3 \leqq v2H$" is established. Herein, v2L represents the lower limit speed, while v2H represents the upper limit speed. The speed range defined by v2L, v2H is used to judge whether or not the key-operation error takes place. As similar to the foregoing speeds v1L, v1H, the speeds v2L, v2H are predetermined by the experimental results and the like in advance. As described above, the lower limit speed and upper limit speed is differed between steps SPb3 (shown in FIG. 12) and SPc3 (shown in FIG. 13) because the key-striking speed which causes the operation error depends on the key-depressing position.

If there is not key-operation error so that the judgement result of step SPc3 is "YES", the processing proceeds to step SPc4 wherein the tone-generation timing T3 is computed based on the presumed string-striking speed V3. This computation is carried out by use of the line 12 shown in FIG. 22. Then, the processing proceeds to step SPc5 wherein it is judged whether or not the presumed string-striking speed V3 and tone-generation timing have been already stored in the memory areas ar7, ar8 of the key event register (see FIG. 10) respectively. If the judgement result of step SPc5 is "YES" indicating that the processes of steps SPb4, SPb5 in FIG. 12 are performed, the processing proceeds to step SPc6 wherein it is judged whether or not the inequality "$T3 < T$" is established. If the judgement result of step SPb6 is "YES", the processing proceeds to step SPc7 wherein data of the memory areas ar7, ar8 in the key event register are respectively rewritten by the presumed string-striking speed V3 and tone-generation timing T3. Thereafter, the processing returns to the main routine.

On the other hand, if the key-operation error is detected in the foregoing step SPc3 in FIG. 13, the memory areas ar7, ar8 are cleared so that the judgement result of step SPc5 is "NO". In this case, the processing directly proceeds from step SPc5 to step SPc7 wherein the presumed string-striking speed V3 and tone-generation timing T3 are written in the memory areas ar7, ar8. In contrast, if the key-operation error is detected so that the judgement result of step SPc3 is "NO", the processing directly returns to the main routine without computing the presumed string-striking speed V3 and tone-generation timing T3.

(d) Step SP11 (Sub-Routine of L4 Key-Depression Process)

Figure 14:
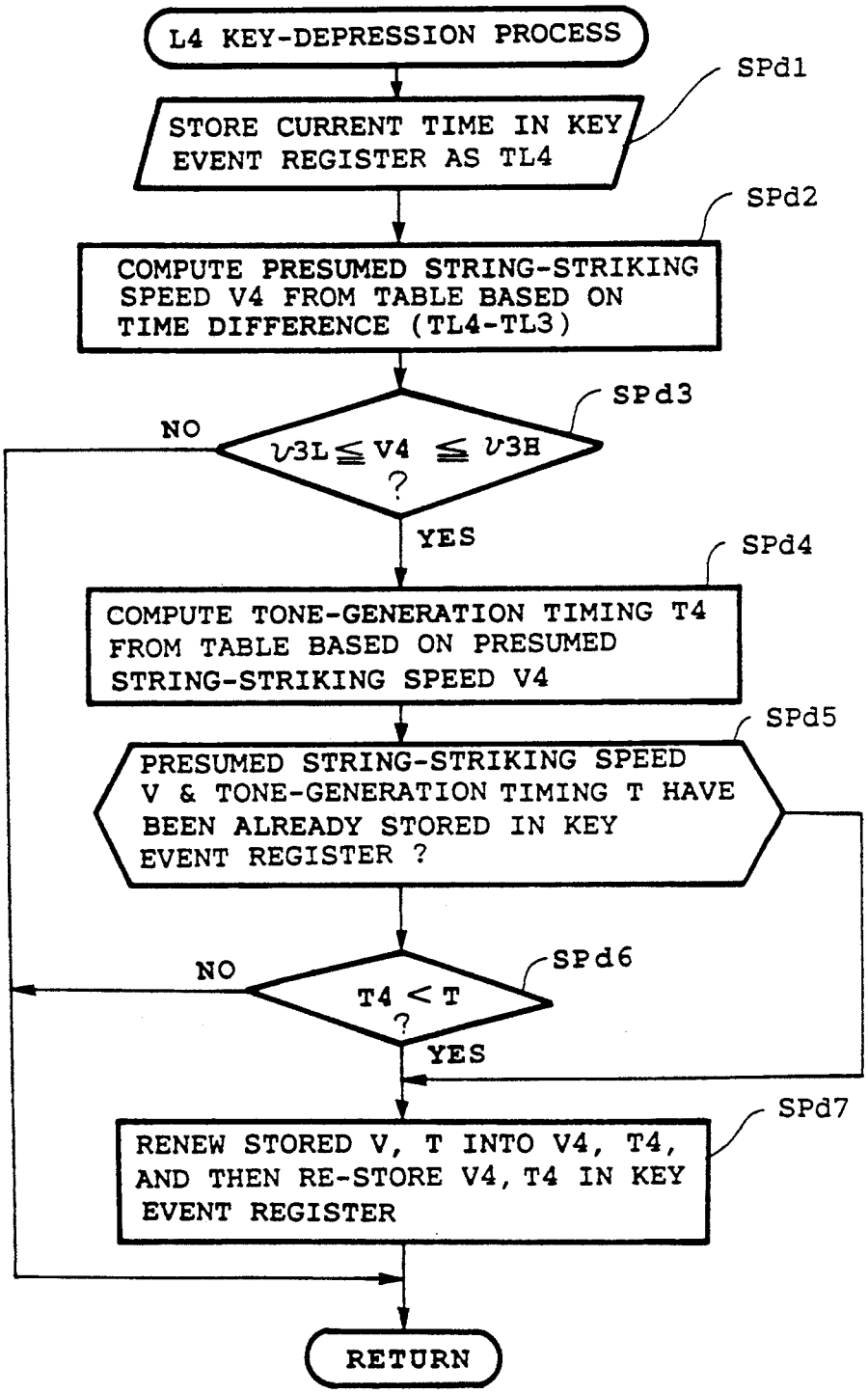

FIG. 14 is a flowchart showing this sub-routine. Steps SPd1 to SPd7 in FIG. 14 correspond to the foregoing steps SPc1 to SPc7 in FIG. 13, hence, description thereof will be omitted. In FIG. 14, lower limit speed v3L and upper limit speed v3H used in step SPd3 are predetermined in response to the fourth measuring point L4. In steps SPd2, SPd4, the CPU computes the presumed string-striking speed V4 and tone-generation timing T4 corresponding to the fourth measuring point L4.

As described above, if there is no key-operation error, the presumed string-striking speed and tone-generation timing are computed every time the key 73 passes through each of the measuring points L2, L3, L4 as shown in FIG. 2. In the case where the computed tone-generation timing T3 or T4 represents the timing which is earlier than its precedingly computed tone-generation timing, the data of the key event register are renewed by the data indicative of the newly computed tone-generation timing and presumed string-striking speed. Thus, the the presumed string-striking speed V and tone-generation timing T which are finally stored in the memory areas ar7, ar8 when the foregoing L4 key-depression process is completed will reflect the variation of the key-depressing speed. In other words, the finally stored tone-generation timing T and presumed string-striking speed will correspond to the actual string-striking speed. Incidentally, if the key-operation error is detected at any one of the measuring points, the stored contents of the memory areas ar7, ar8 are cleared.

(e) Key Event Timer Interrupt Process Routine

This is the routine which generates NOTE-ON signal of MIDI signal in real-time manner based on the tone-generation timing T stored in the memory area ar8 of the key event register. This routine is activated by the timer interrupt event which is different from that of the main routine as shown in FIG. 8. For example, this routine is activated by 1 ms, and FIG. 19 shows the flowchart of this routine.

Figure 19:
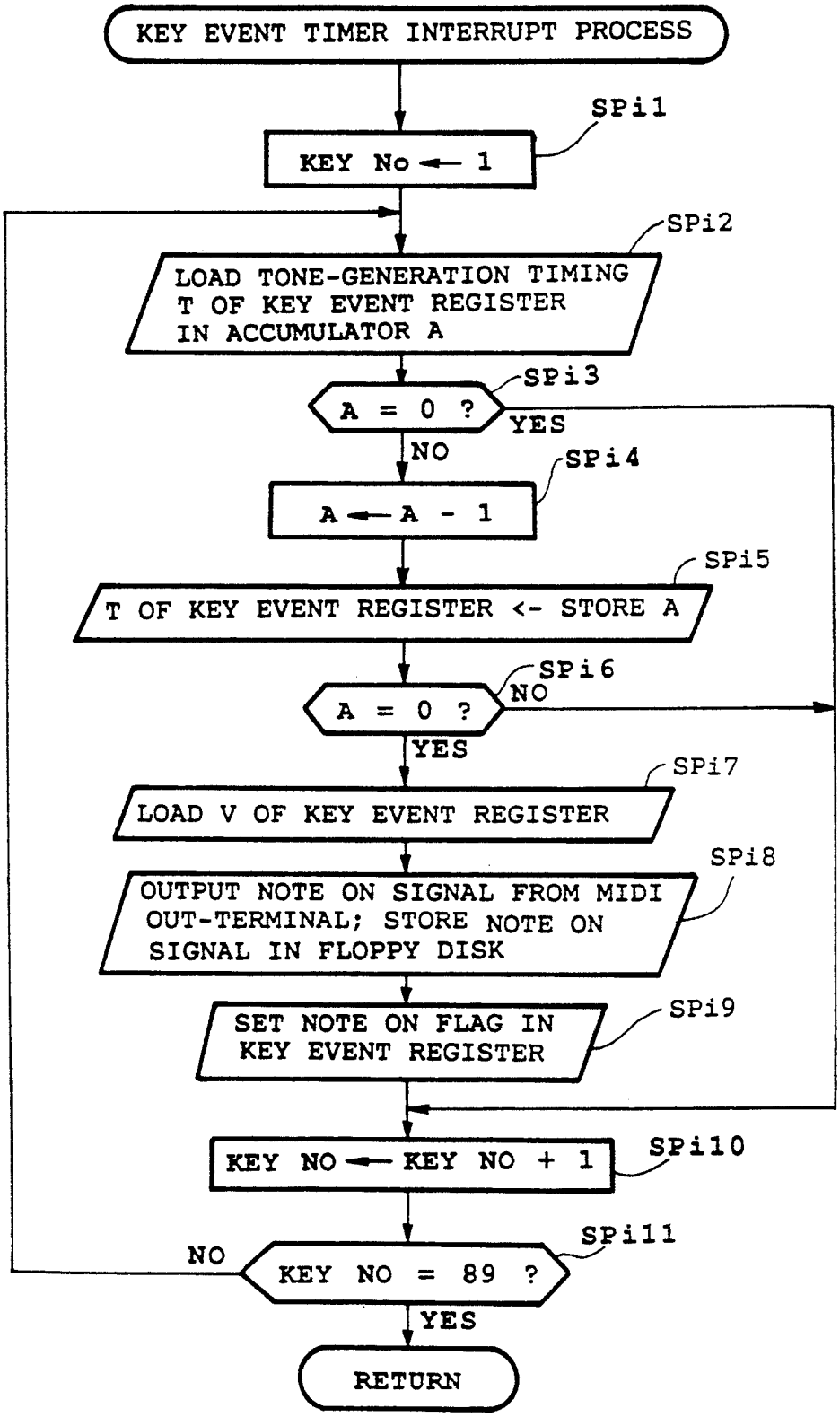

In first step SPi1 of FIG. 19, "1" is set in a key number register indicated by "Key No" which is set in the RAM of the main micro computer 91 shown in FIG. 2. In next step SPi2, the tone-generation timing T stored in the memory area ar8 (see FIG. 10) is read by an accumulator A set in the CPU of the main micro computer 91. Then, step SPi3 judges whether or not the value set in the accumulator A is equal to "0". In the case where the tone-generation timing T is computed with respect to the key number "1" by executing each of the sub-routines in steps SP8 to SP11, the judgement result of step SPi3 turns to "NO" so that the processing proceeds to step SPi4 wherein the value set in the accumulator A is decremented by "1". In next step SPi5, the decremented value of the accumulator A is stored in the memory area ar8. In step SPi6, it is judged whether or not the value of the accumulator A is "0". If the judgement result of step SPi6 is "YES", the processing proceeds to step SPi7 wherein the accumulator A reads the presumed string-striking speed V which is stored in the memory area ar7 with respect to the key number "1". In step Spi8, the control signal is supplied to the local micro computer 93 so that the MIDI signal is outputted via the MIDI terminal. In this case, the MIDI signal is NOTE-ON signal.

Herein, according to the MIDI standard, status-byte of ON signal is expressed by 9X (where X denotes the channel No.) in the hexadecimal notation. In addition, second byte of the MIDI signal represents the note number. In this case, the note number corresponding to the key number "1" is set in the MIDI signal. Further, third byte of the MIDI signal represents the velocity data (corresponding to the string-striking speed). Therefore, the presumed string-striking speed V read in the foregoing step SPi7 is set in the MIDI signal. In step SPi8, the above-mentioned MIDI signal is written in the floppy disk 101 by the floppy disk driver 99.

Next, the processing proceeds to step SPi9 wherein the CPU sets the on/off flag in the memory area ar9 of the key event register. In next step SPi1O, the value set in the key number register "Key No" is incremented by "1".

In the present embodiment, the reason why the NOTE-ON signal is outputted at the timing when the value of the accumulator A is at "0" is as follows. The value of the accumulator A is incremented by "1" every time the present routine is activated by 1 ms. Therefore, the timing when the tone-generation timing T to be read by the accumulator A becomes equal to "0" corresponds to the timing of generating the tone which is sounded by striking the string corresponding to the current key number.

On the other hand, if the judgement result of step SPi6 is "NO", the processing directly proceeds to step SPilO wherein the key number register "Key No" is incremented by "1". Then, the processing proceeds to step SPi11 wherein it is judged whether or not the value set in the key number register "Key No" reaches "89". If not, the processing returns to the foregoing step SPi2 again. Meanwhile, if the judgement result of step SPi3 is "YES" indicating the case where the key-depression event is not occurred or the key-operation error is detected by the foregoing steps SP8 to SP11, the processing directly proceeds to step SPi1O without forming the NOTE-ON signal.

Thereafter, the above-mentioned processes are repeated. In other words, it is judged whether or not the NOTE-ON signal is formed with respect to each of the key numbers "1" to "88". If it is judged that the NOTE-ON signal is formed, the main micro computer 91 generates the MIDI signal having the velocity data corresponding to the presumed string-striking speed V stored in the memory area ar7.

Then, when the key-scanning is completely carried out with respect to all keys, the judgement result of step SPi11 turns to "YES" so that the processing returns back to its original routine.

(2-B) Key-Returning Operation

Next, description will be given with respect to several processes to be executed in the key-returning operation.

When the key is depressed at the key bottom position, the present system enters into the mode of key-returning operation after the key passes the fourth measuring point away. In such key-returning operation, the key will pass the measuring points in the order of L4→L3→L2→L1. At each timing when the key passes each measuring point, each of the sub-routines in steps SP12 to SP15 is to be executed.

(a) Step SP12 (Sub-Routine of L4 Key-Return Process)

Figure 15:
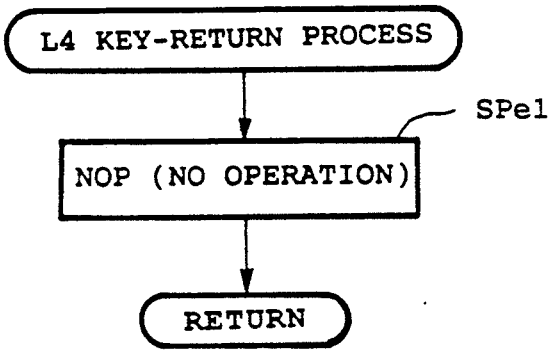
Figure 16:
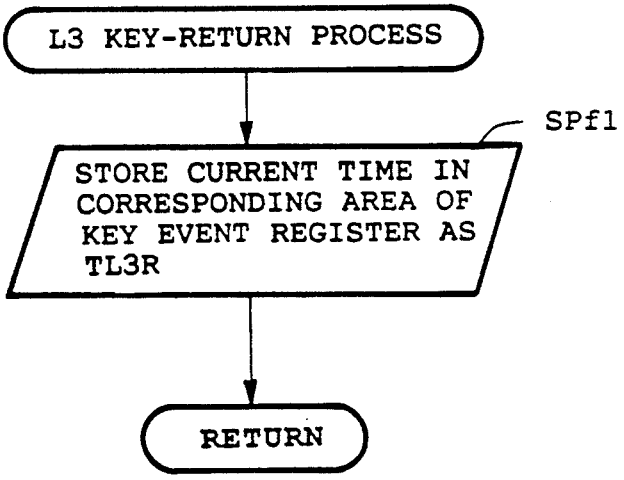

When the key passes the fourth measuring point L4 in the key-returning operation, the present system is at stand-by state and waits for the next passing time of the key which passes the next measuring point L3 (see FIG. 15).

(b) Step SP13 (Sub-Routine of L3 Key-Return Process)

When the key 73 passes the measuring point L3 in the key-returning operation, this event is detected by the processes shown in FIG. 8 so that the processing proceeds to L3 key-return process of step SP13. In this process, the current time is stored in the memory area ar6 of the key event register (see FIG. 10) as data TL3R (see step SPf1 in FIG. 16). Thereafter, the processing returns to the main routine.

(c) Step SP14 (Sub-Routine of L2 Key-Return Process)

Figure 17:
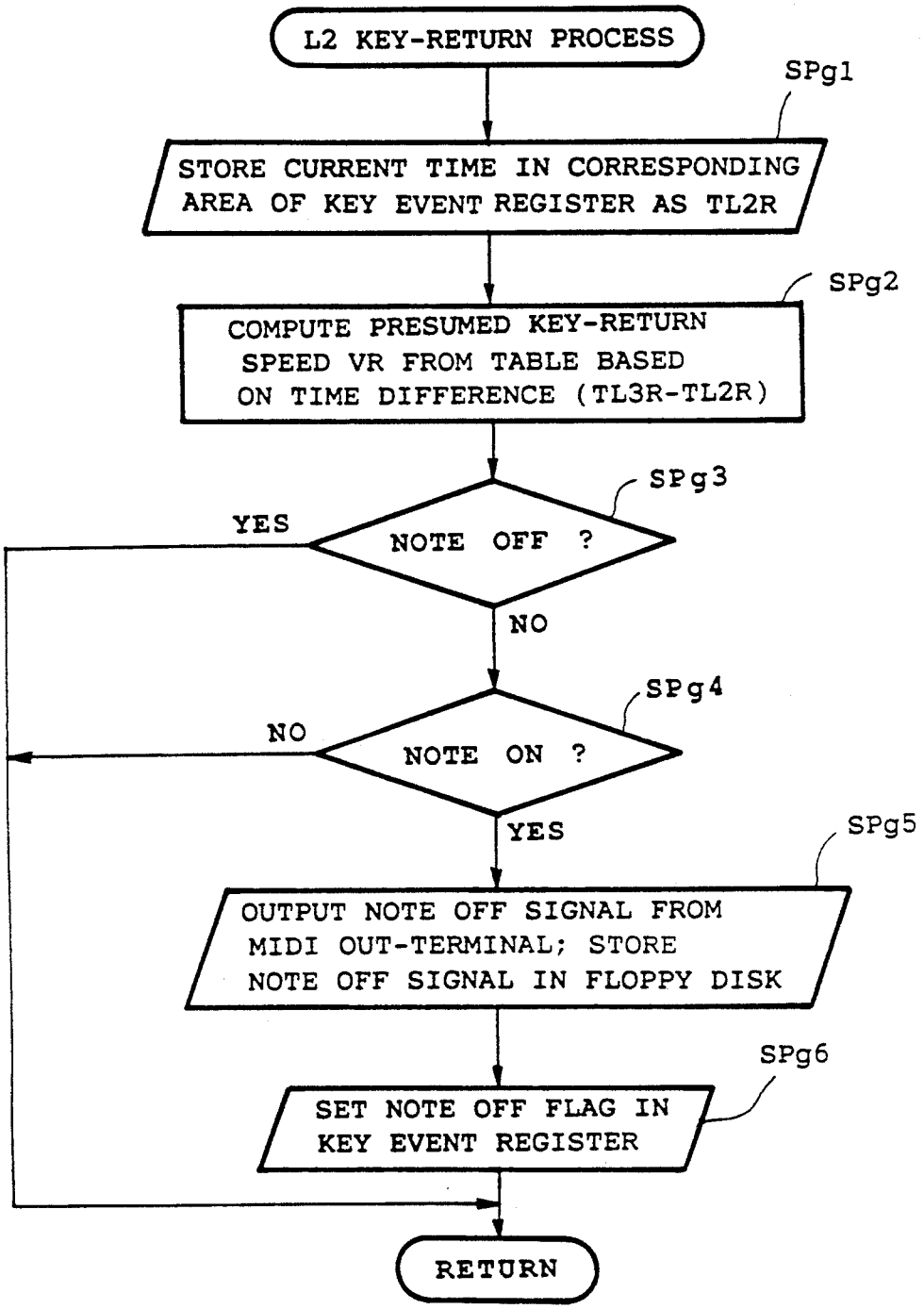
Figure 23:
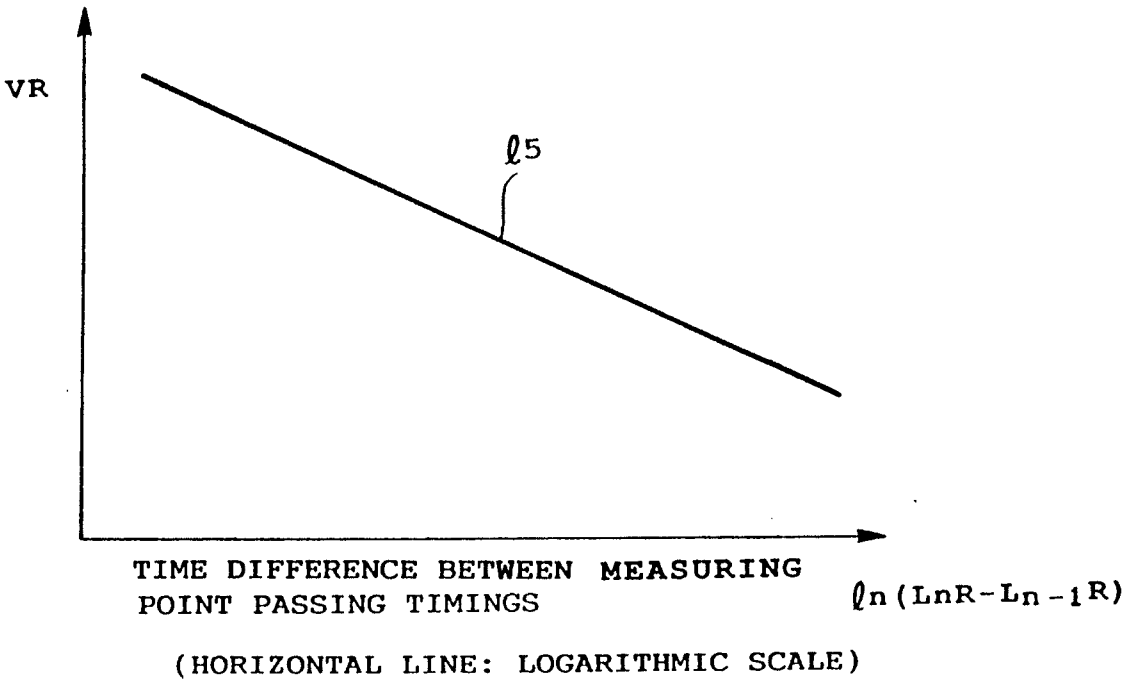
Figure 24:
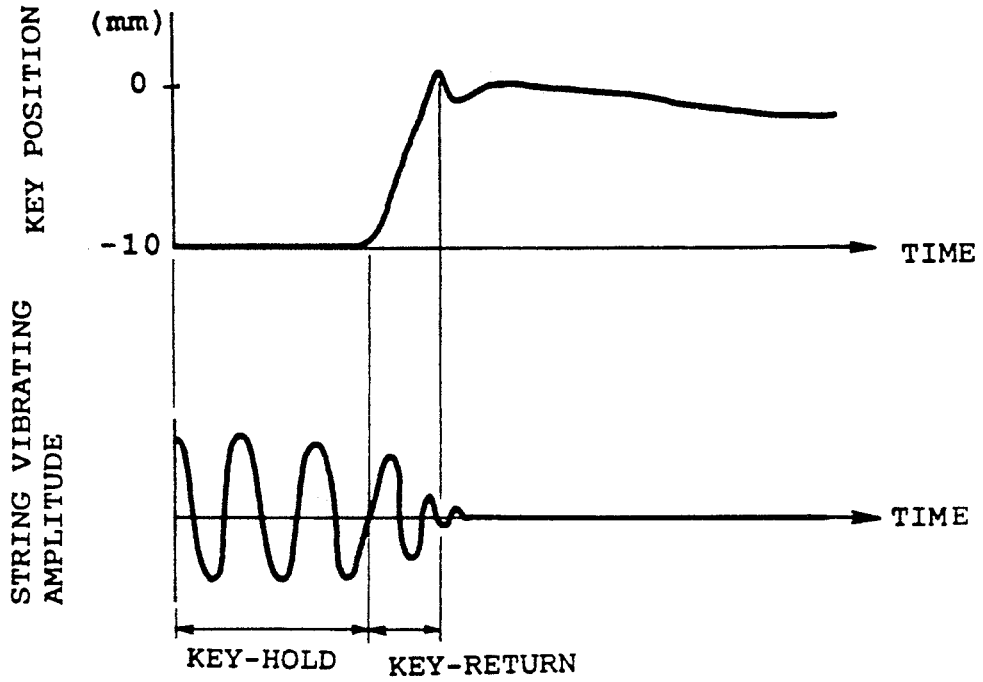
FIGS. 24, 25 are timing charts showing relations between key positions and string vibrations.
Figure 25:
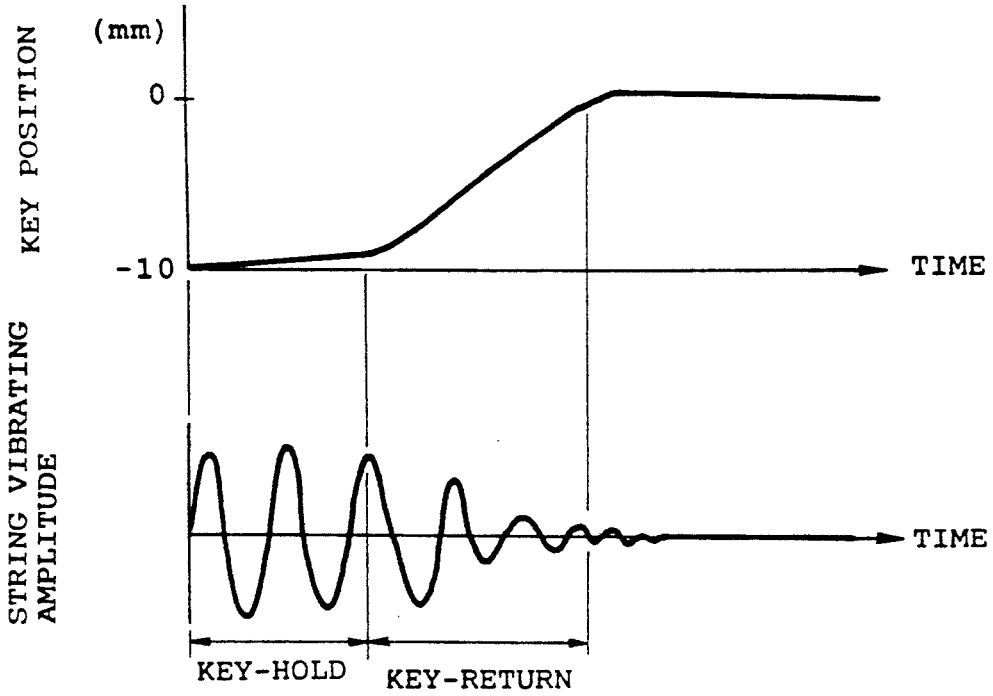

In step SPg1 of FIG. 17, the current time is stored in the memory area ar5 of the key event register as data TL2R. In next step SPg2, time difference (TL3R-TL2R) is obtained based on the data TL3R, TL2R read from the memory area ar5, ar6. Then, a presumed key-return speed VR is computed based on this time difference (TL3R-TL2R). This computation is carried out by the table which is pre-stored in the ROM of the main micro computer 91 (see FIG. 7) in advance. The contents of this table can be indicated by the graph shown in FIG. 23, wherein vertical line represents the presumed key-return speed VR and horizontal line represents the logarithmic value of the time difference (TL3R-TL2R). FIG. 23 shows a line 15 in which the presumed key-return speed is increased in inverse proportion to the logarithmic value of the time difference. In accordance with this line 15, the presumed key-return speed VR is computed.

The reason why the presumed key-return speed VR is computed when the key-return position corresponds to the second measuring point L2 is as follows. In fact, when the key-return position passes the second measuring point L2, the damper 78 starts to suspend vibration of the string 79 (see FIG. 2). At this timing, the key-return speed affects the operation of suspending the tone-generation (in legato, non-legato etc.). In other words, in order to suspend the tone-generation, the most significant key-return speed is that at the timing when the key is returned to be at the second measuring point L2. The presumed key-return speed VR computed at this timing will represent the operation of the damper 78 in response to the touch operation of the performer. In addition, the passing time (TL3R–TL2R) of the key which passes between the measuring points L2, L3 has strong correlation to the key-return speed at the moment when the key passes the second measuring point L2. Herein, by use of the table which stores the relation between the passing time (TL3R–TL2R) and the key-return speed of the key which passes the second measuring point L2 (see FIG. 23), the presumed key-return speed VR is computed. Therefore, the computation result obtained in step SPg2 coincides with the actual key-return speed of the key which passes the second measuring point L2 with accuracy.

Next, the processing proceeds to step SPg3 wherein it is judged whether or not the on/off flag stored in the memory area ar9 of the key event register is at "0", i.e., it is judged whether or not the "NOTE-OFF" event is occurred. If the key-operation is normally carried out without causing any error, the tone-generation timing T is computed by the sub-routines of steps SP9 to SP11 (see FIGS. 12 to 14) every time the key passes the measuring point L2, L3, L4 in the key-depressing operation, so that "NOTE-OFF" event is not detected in step SPg3. In contrast, in case of the key-operation error, the tone-generation timing T is not computed so that step SPg3 detects the "NOTE-OFF" event, even if the key-movement is changed from key-depressing movement to key-returning movement after the depressed key passes any one of the measuring points L2, L3, L4. In short, the judging process of step SPg3 is provided for detecting and then omitting the key-operation error. If the judgement result of step SPg3 is "YES" indicating that the key-operation error takes place, the processing directly returns to the main routine without performing processes of steps SPg4 etc. On the other hand, if the judgement result of step SPg3 is "NO", the processing proceeds to step SPg4 wherein it is judged whether or not the on/off flag stored in the memory area ar9 is at "1", i.e., it is judged whether or not the "NOTE-ON" event is occurred. In general, if the judgement result of step SPg3 is "NO", the judgement result of next step SPg4 must be "YES". However, in order to raising the judgement precision, the judging process of step SPg4 wherein "NOTE-ON" is judged is provided in the present embodiment.

If the judgement result of step SPg4 is "YES", the processing proceeds to step SPg5 wherein the control signal is supplied to the local micro computer 93 so that the MIDI signal will be outputted via the MIDI terminal. At this time, the MIDI signal represents the NOTE-OFF signal. The status byte of the NOTE-OFF signal is indicated by "8X" (where X denotes the channel No.) expressed in the hexadecimal notation according to the MIDI standard. In addition, the note number corresponding to the current key number is set in the second byte of the MIDI signal. Further, the presumed key-return speed VR computed in the foregoing step SPg2 is set at the third byte (indicating the velocity data, i.e., string-striking speed) of the MIDI signal. In step SPg5, the above-mentioned MIDI signal is written into the floppy disk 101 by the floppy disk driver 99. In next step SPg6, the on/off flag stored in the memory area ar9 is reset. Thereafter, the processing returns to the main routine.

On the other hand, if the judgement result of step SPg3 is "YES" or the judgement result of step SPg4 is "NO", the processing returns to the main routine without forming the NOTE-OFF signal.

(d) Step SP15 (Sub-Routine of L1 Key-Return Process)

Figure 18:
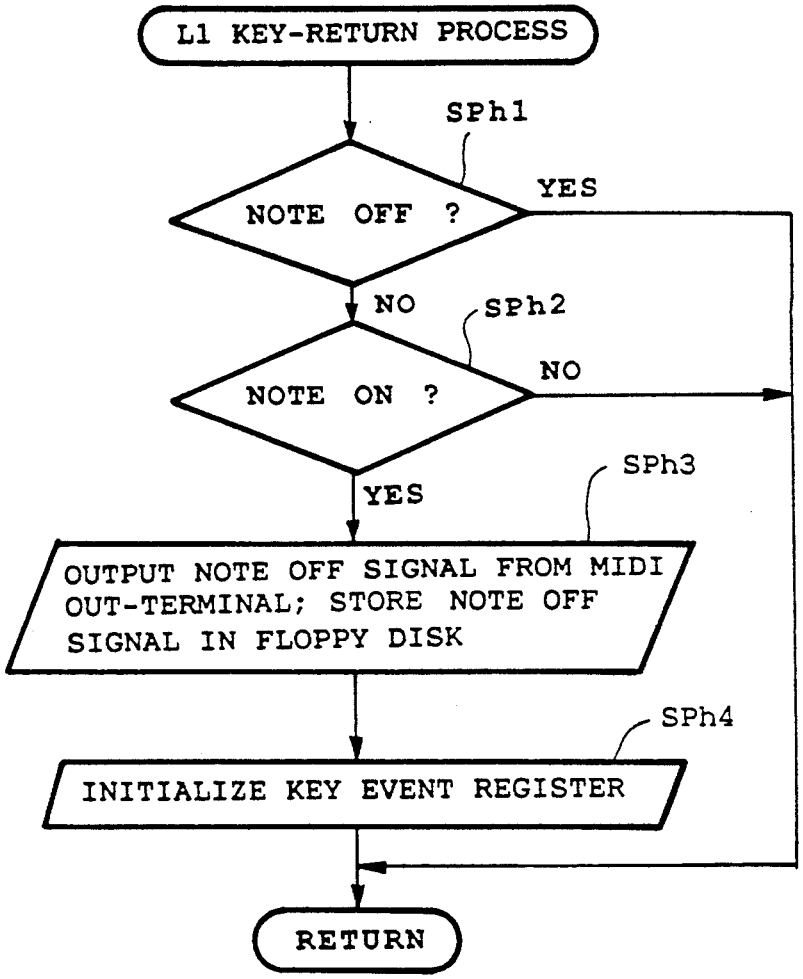

FIG. 18 is a flowchart showing this sub-routine. Steps Sph1, SPh2, SPh3 in FIG. 18 are similar to the foregoing steps SPg3, SPg4, SPg5 in FIG. 17, hence, description thereof will be omitted. Herein, the NOTE-OFF signal formed in step SPh3 includes the velocity data representing the presumed key-return speed VR computed in the foregoing step SPg5. In the present embodiment, the presumed key-return speed VR is not computed when the returned key reaches the first measuring point L1, because the key-return speed of the key which passes the second measuring point L2 is the most significant value used for controlling the damper operation which suspends the tone-generation. Therefore, the present sub-routine of FIG. 18 only controls the generation of the NOTE-OFF signal.

In step SPh4, the CPU clears the memory block (including memory areas ar1 to ar9) in the key event register corresponding to the number of the currently operated key. This clearing operation must be carried out in order to prepare for the next key-depression after a series of key-depression/key-return operations is completed when the returned key reaches at the first measuring point L1.

(2-C) Whole Operation

As described heretofore, when the performer depresses the key 73 to the point lower than the second measuring point L2, the presumed sting-striking speed V and tone-generation timing T are computed in response to the timing when the key passes each measuring point. At the time corresponding to the tone-generation timing T, the main micro computer 91 forms the MIDI signal (i.e., NOTE-ON signal) having the velocity data corresponding to the presumed string-striking speed V. In the case where the key-depression speed is varied before forming the MIDI signal, the presumed string-striking speed V is renewed at every variation timing, so that the velocity data of the MIDI signal will reflect the variation of the key-depression speed. Meanwhile, the presumed string-striking speed V obtained when the key-operation error occurs is not used so that the tone-generation timing T is not computed. Therefore, in case of the key-operation error, the MIDI signal is not formed.

On the other hand, in the key-returning operation, the presumed key-return speed VR is computed in response to the passing time of the returned key which passes each measuring point. Then, the main micro computer 91 forms the MIDI signal (i.e., NOTE-OFF signal) having the velocity data corresponding to the presumed key-return speed VR. Since the NOTE-OFF signal includes the velocity data corresponding to the key-return speed, the automatic performance piano can control the damper operation which mutes the sound in response to the NOTE-OFF signal.

[C] MODIFIED EXAMPLES (1) In the present embodiment described heretofore, the presumed string-striking speed, tone-generation timing and presumed key-return speed are computed by use of respective tables. However, instead of using such tables, it is possible to computes them by use of computation formulae which are predetermined in advance.

(2) It is possible to detect the key-operation error in response to the time difference between the timings when the key passes the adjacent measuring points. In other words, it is possible to detect the key-operation error in response to the key-striking speed itself.

As described heretofore, this invention may be practiced or embodied in still other ways without departing from the spirit or essential character thereof. Therefore, the preferred embodiment described herein is illustrative and not restrictive, the scope of the invention being indicated by the appended claims and all variations which come within the meaning of the claims are intended to be embraced therein.

What is claimed is:

1. An automatic performance piano system comprising:

(a) an automatic performance piano having a recording mode in which information of a performance including key-return speed is recorded and an automatic performance mode in which a pre-recorded performance is reproduced;

(b) a key-return speed detecting unit, operable at least during the recording mode, for detecting a key-return speed when a depressed key is released at a point substantially corresponding to when a damper in the piano starts to prevent vibration of a corresponding piano string;

(c) a recording means coupled to the key-return speed detecting unit for recording a key-return speed detected during the recording mode; and (d) an automatic performance means responsive to the recording means for causing the piano to automatically reproduce a pre-recorded performance, whereby an automatic performance can be carried out with high fidelity by use of a detected key-return speed.

2. An automatic performance piano system according to claim 1 wherein said key-return speed detecting unit further comprises:

(a) position detecting means for detecting plural key-return positions of a key provided in said automatic performance piano;

(b) judgment means for judging whether or not a currently detected key-return position coincides with a specific position where a speed detection is to be carried out; and (c) computing means for computing said key-return speed based on a passing time in which said key passes between said specific position and a predetermined position disposed prior to said specific position in a key-return direction when said judgment means judges that said currently detected key-return position coincides with said specific position.

3. An automatic performance piano system according to claim 2 wherein said computing means provides a table storing a relation between said passing time and said key-return speed which is occurred at a moment when said key passes said specific position, said computing means computes said key-return speed corresponding to said passing time by use of said table.

4. An automatic performance piano system comprising:

(a) an automatic performance piano having a recording mode in which information of a performance including string striking speed is recorded and an automatic performance mode in which a pre-recorded performance is reproduced;

(b) a string-striking speed presuming unit, operable at least during the recording mode, for determining speed of a key of the piano at plural points during depression of the key and on the basis of the determined speeds presuming a string-striking speed of a hammer which strikes a string in response to depression of the key;

(c) a recording means coupled to the string-striking speed presuming unit for recording a presumed string-striking speed determined during the recording mode; and (d) an automatic performance means responsive to the recording means for causing the piano to automatically reproduce a pre-recorded performance, whereby an automatic performance can be carried out with high fidelity by use of a presumed string-striking speed.

5. An automatic performance piano system according to claim 4 wherein said string-striking speed presuming unit further comprises:

(a) position detecting means for outputting a detection signal every time said key to be depressed or released is positioned at each of a plurality of reference key-positions;

(b) key-striking speed detecting means for detecting a key-striking speed at a current reference position when said key is depressed based on a first time when a preceding detection signal is generated by said position detecting means and a second time when a current detection signal is generated by said position detecting means;

(c) memory means for pre-storing a relation between a key-striking speed and said string-striking speed of said hammer;

(d) presuming means for presuming said string-striking speed corresponding to a detected key-striking speed by use of said pre-stored relation, so that a presumed string-striking speed is obtained with respect to said current reference position;

(e) renewing means for renewing a previously presumed string-striking speed by a currently presumed string-striking speed when said currently presumed string-striking speed is larger than said previously presumed string-striking speed.

6. An automatic performance piano system according to claim 5 wherein said string-striking speed presuming unit further includes:

(a) judgment means for judging whether or not said presumed string-striking speed is within a predetermined reference range; and (b) means for omitting said presumed string-striking speed which is outside said predetermined reference range from a presuming result of said presuming means, so that a key-operation error can be detected and omitted.

7. An automatic performance piano comprising:

a piano having a plurality of keys which are depressed to cause corresponding hammers to strike strings and released to cause the keys to return and corresponding dampers to contact the strings;

recording means for recording information of a performance on the piano including (a) determining means for determining key depression/release, key-depression speed and key-return speed, wherein key depression/release and key-return speed are determined on the basis of the key passing predetermined reference points which are different for key depression/release and key-return speed, and (b) means for determining performance information based on the determined key depression/release, key depression speed and key-return speed; and automatic performance means responsive to the recording means for causing the piano to automatically reproduce a pre-recorded performance.

8. An automatic performance piano as in claim 7 wherein the speed determining means includes means for determining key depression speed corresponding to a plurality of key positions and presuming a string striking speed based on the determined speeds.

9. An automatic performance piano as in claim 8 wherein string striking speed is presumed based upon the maximum determined key-depression speed.

10. An automatic performance piano as in claim 8 wherein the speed determining means includes means for determining key-return speed at a key position corresponding substantially to a point where a damper contacts the corresponding string.

11. An automatic performance piano as in claim 7 wherein the speed determining means includes means for determining key-return speed at a key position corresponding substantially to a point where a damper contacts the corresponding string.

* * * * *